US012768571B2

(12) United States Patent
Kato et al.

(10) Patent No.: US 12,768,571 B2
(45) Date of Patent: Oct. 20, 2026

(54) REFRIGERATION CYCLE DEVICE

(71) Applicant: DENSO CORPORATION, Kariya-city (JP)

(72) Inventors: Daiki Kato, Kariya-city (JP); Norihiko Enomoto, Kariya-city (JP); Yuichi Kami, Kariya-city (JP)

(73) Assignee: DENSO CORPORATION, Kariya-city (JP)

( * ) Notice: Subject to any disclaimer, the term of this patent is extended or adjusted under 35 U.S.C. 154(b) by 156 days.

(21) Appl. No.: 18/773,926

(22) Filed: Jul. 16, 2024

(65) Prior Publication Data

US 2024/0369265 A1 Nov. 7, 2024

Related U.S. Application Data

(63) Continuation of application No. PCT/JP2022/045447, filed on Dec. 9, 2022.

(30) Foreign Application Priority Data

Jan. 18, 2022 (JP) ..... 2022-005681

(51) Int. Cl.
*F25B 5/02* (2006.01)
*F25B 41/40* (2021.01)
*F25B 49/02* (2006.01)

(52) U.S. Cl.
CPC ..... *F25B 5/02* (2013.01); *F25B 41/40* (2021.01); *F25B 49/02* (2013.01)

(58) Field of Classification Search
CPC .... F25B 1/00; F25B 5/02; F25B 41/20; F25B 41/40; F25B 25/005; F25B 43/00; F25B 43/006; F25B 49/02; F25B 2600/2501; B60H 1/00278; B60H 2001/00307; B60H 2001/00928; B60H 1/3204
See application file for complete search history.

(56) References Cited

U.S. PATENT DOCUMENTS 6,092,379 A 7/2000 Nishida et al.
2006/0137388 A1 6/2006 Kakehashi et al.
(Continued)

FOREIGN PATENT DOCUMENTS

JP 2000035250 A 2/2000
JP 2006145170 A 6/2006
JP 2006177632 A 7/2006

*Primary Examiner* — Paul Alvare
*Assistant Examiner* — Kamran Tavakoldavani
(74) *Attorney, Agent, or Firm* — Harness, Dickey & Pierce, P.L.C.

(57) ABSTRACT

A refrigeration cycle device includes first and second evaporation units connected in parallel to a flow of a refrigerant, and an accumulator. When a path of an energy flow in which heat of a first object to be cooled moves to a suction refrigerant drawn into a compressor is defined as a first path, and when a path of an energy flow in which heat of a second object to be cooled moves to the suction refrigerant is defined as a second path, the accumulator is disposed in at least one of the first path and the second path. Furthermore, the refrigeration cycle device is provided with a first switching unit switched such that heat of the first object to be cooled is moved while bypassing the accumulator, and a second switching unit switched such that heat of the second object to be cooled is moved while bypassing the accumulator.

11 Claims, 12 Drawing Sheets

(56) References Cited

U.S. PATENT DOCUMENTS

| | | | | |
|---|---|---|---|---|
| 2015/0052925 | A1* | 2/2015 | Hata | F25B 1/10 62/228.3 |
| 2018/0195794 | A1* | 7/2018 | Saunders | F25B 31/00 |

* cited by examiner

FIRST COOLING MODE

SECOND COOLING MODE

FIRST COMPOSITE COOLING MODE

SECOND COMPOSITE COOLING MODE

THIRD COMPOSITE COOLING MODE

FIRST COOLING MODE

SECOND COOLING MODE

FIRST COMPOSITE COOLING MODE

SECOND COMPOSITE COOLING MODE

COMPARATIVE OPERATION MODE

FIRST COMPOSITE COOLING MODE

REFRIGERATION CYCLE DEVICE

CROSS REFERENCE TO RELATED APPLICATION

The present application is a continuation application of International Patent Application No. PCT/JP2022/045447 filed on Dec. 9, 2022, which designated the U.S. and claims the benefit of priority from Japanese Patent Application No. 2022-005681 filed on Jan. 18, 2022. The entire disclosures of all of the above applications are incorporated herein by reference.

TECHNICAL FIELD

The present disclosure relates to a refrigeration cycle device including a plurality of evaporation units and an accumulator.

BACKGROUND

In a refrigeration cycle device applied to a vehicle air conditioner, the refrigeration cycle device may include a plurality of evaporation units such as a front seat evaporator and a rear seat evaporator, and an accumulator that is a low-pressure gas-liquid separator configured to store a surplus refrigerant for a refrigerant cycle.

In the refrigerant cycle of the refrigeration cycle device, a refrigerant outlet of the front seat evaporator is connected to an inlet of the accumulator, and a refrigerant outlet of the rear seat evaporator is connected to an outlet of the accumulator. In this case, the refrigerant flowing out of the front seat evaporator flows into the accumulator, and the refrigerant flowing out of the rear seat evaporator bypasses the accumulator and is guided to the suction port of the compressor.

SUMMARY

In a refrigeration cycle device according to a first aspect of the present disclosure, a path of an energy flow in which heat of a first object to be cooled moves to a suction refrigerant drawn into a compressor via at least one of a first evaporation unit and a second evaporation unit may be defined as a first path, and a path of an energy flow in which heat of a second object to be cooled moves to the suction refrigerant via at least one of the first evaporation unit and the second evaporation unit may be defined as a second path.

In this case, an accumulator is disposed in at least one of the first path and the second path. When the accumulator is disposed in the first path, a refrigeration circuit includes a first bypass path and a first switching unit. The first bypass path is a path through which heat of the first object to be cooled moves while bypassing the accumulator. The first switching unit is capable of switching between a first circulation mode in which heat of the first object to be cooled is moved via the accumulator, and a first bypass circulation mode in which heat of the first object to be cooled is moved via the first bypass path.

When the accumulator is disposed in the second path, the refrigeration circuit includes a second bypass path and a second switching unit. The second bypass path is a path through which heat of the second object to be cooled moves while bypassing the accumulator. The second switching unit is capable of switching between a second circulation mode in which heat of the second object to be cooled is moved via the accumulator, and a second bypass circulation mode in which heat of the second object to be cooled is moved via the second bypass path.

A refrigeration cycle device according to a second aspect of the present disclosure is provided with a bypass passage and a refrigerant circuit switching unit. The bypass passage is configured to guide at least one of refrigerant flowing out of a first evaporation unit and refrigerant flowing out of a second evaporation unit to a suction port of the compressor while bypassing the accumulator. The refrigerant circuit switching unit is configured to switch a refrigerant cycle in which at least one of the refrigerant flowing out of the first evaporation unit and the refrigerant flowing out of the second evaporation unit flows into the accumulator.

A refrigeration cycle device according to a third aspect of the present disclosure is provided with a heat medium circuit and a heat medium circuit switching unit.

The heat medium circuit is configured to circulate a heat medium that conveys heat of a first object to be cooled and heat of a second object to be cooled. The heat medium circuit switching unit is configured to switch a heat medium circuit in which heat is exchanged between the heat medium having heat-absorbed from at least one of the first object to be cooled and the second object to be cooled, and refrigerant flowing through a first evaporation unit in first and second evaporation units.

BRIEF DESCRIPTION OF DRAWINGS

The above object and other objects, features, and advantages of the present disclosure will become more apparent from the following detailed description with reference to the accompanying drawings. In which.

DESCRIPTION OF EMBODIMENTS

Figure 1:
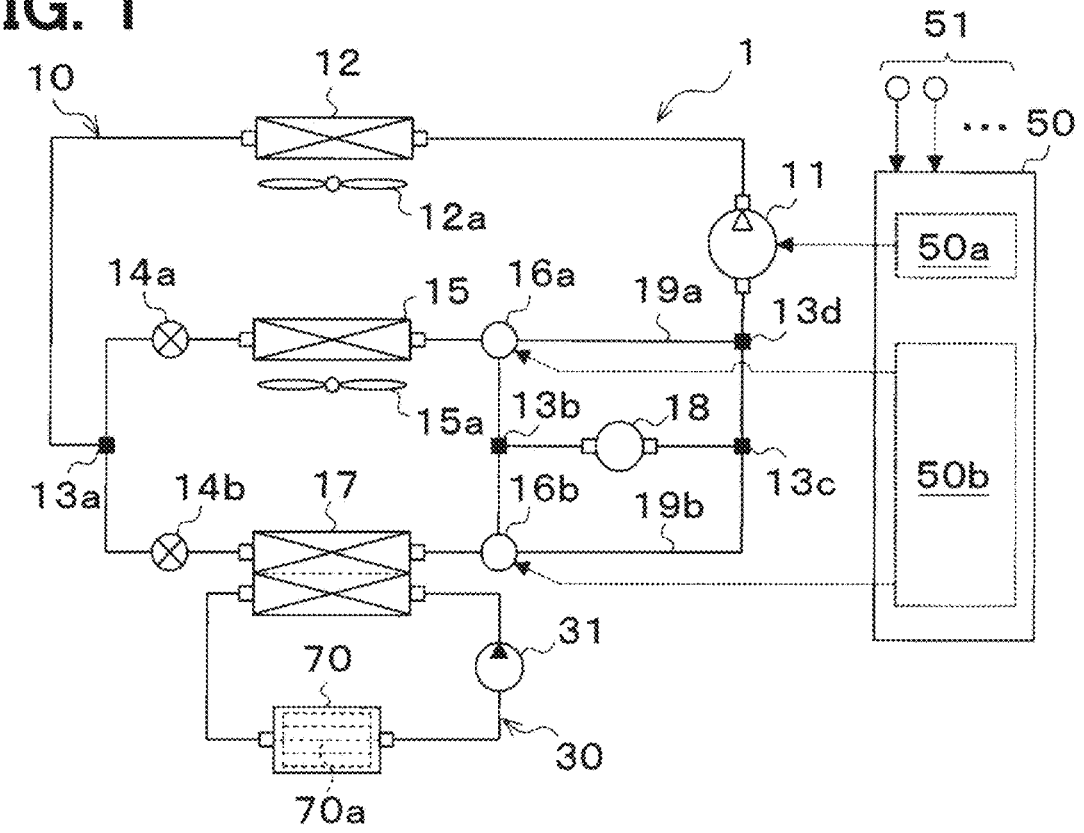
FIG. 1 is a schematic overall configuration diagram of a refrigeration cycle device according to the first embodiment.

In recent years, a refrigeration cycle device, which includes a plurality of evaporation units and an accumulator, and cools a plurality of types of objects to be cooled in different temperature zones, has been developed. For example, as a refrigeration cycle device applied to a vehicle air conditioner mounted on an electric vehicle, a refrigeration cycle device for cooling not only ventilation air blown into the vehicle interior but also a battery and other in-vehicle devices has been developed.

In a refrigeration cycle device including a plurality of evaporation units for cooling a plurality of types of objects to be cooled, when a temperature condition or the like of each object to be cooled changes, it may be necessary to switch between an evaporator that supplies a refrigerant and an evaporator that does not supply a refrigerant.

In the refrigeration cycle device including the plurality of evaporation units for cooling the plurality of types of objects to be cooled, it is necessary to appropriately adjust the cooling capacity of each evaporation unit according to the temperature condition and the like of each object to be cooled.

A refrigeration cycle device applied to a vehicle air conditioner may include a plurality of evaporation units such as a front seat evaporator and a rear seat evaporator, and an accumulator that is a low-pressure gas-liquid separator configured to store a surplus refrigerant for a refrigerant cycle. A refrigerant outlet of the front seat evaporator is connected to an inlet of the accumulator, and a refrigerant outlet of the rear seat evaporator is connected to an outlet of the accumulator. In this case, the refrigerant flowing out of the front seat evaporator flows into the accumulator, and the refrigerant flowing out of the rear seat evaporator bypasses the accumulator and is guided to the suction port of the compressor.

However, in the refrigeration cycle device, the cooling capacity of the rear seat evaporator can be relatively easily adjusted by changing the degree of superheat of the outlet refrigerant of the rear seat evaporator, but the cooling capacity of the front seat evaporator is not easily adjusted. This is because the accumulator is connected to the refrigerant outlet of the front seat evaporator, and the outlet refrigerant of the front seat evaporator approaches the saturated gas refrigerant.

In view of the above, an object of the present disclosure is to provide a refrigeration cycle device including a plurality of evaporation units and an accumulator, and being capable of causing the evaporation units to exhibit appropriate cooling capacity.

A refrigeration cycle device according to a first aspect of the present disclosure includes a first evaporation unit and a second evaporation unit, an accumulator, and a compressor.

The first evaporation unit and the second evaporation unit are configured to evaporate a refrigerant circulating in a refrigerant circuit, and are connected in parallel to a flow of the refrigerant. The accumulator is configured to separate the refrigerant flowing out of at least one of the first evaporation unit and the second evaporation unit into gas and liquid, and to store a surplus refrigerant. The compressor is configured to draw and compress a gas refrigerant separated in the accumulator.

A path of an energy flow in which heat of a first object to be cooled moves to a suction refrigerant drawn into the compressor via at least one of the first evaporation unit and the second evaporation unit is defined as a first path, and a path of an energy flow in which heat of a second object to be cooled moves to the suction refrigerant via at least one of the first evaporation unit and the second evaporation unit is defined as a second path.

In this case, the accumulator is disposed in at least one of the first path and the second path.

When the accumulator is disposed in the first path, the refrigeration circuit includes a first bypass path and a first switching unit.

The first bypass path is a path through which heat of the first object to be cooled moves while bypassing the accumulator. The first switching unit is capable of switching between a first circulation mode in which heat of the first object to be cooled is moved via the accumulator, and a first bypass circulation mode in which heat of the first object to be cooled is moved via the first bypass path.

When the accumulator is disposed in the second path, the refrigeration circuit includes a second bypass path and a second switching unit.

The second bypass path is a path through which heat of the second object to be cooled moves while bypassing the accumulator. The second switching unit is capable of switching between a second circulation mode in which heat of the second object to be cooled is moved via the accumulator, and a second bypass circulation mode in which heat of the second object to be cooled is moved via the second bypass path.

As described above, the accumulator is disposed in at least one of the first path and the second path. Therefore, the refrigerant that has absorbed at least one of the heat of the first object to be cooled and the heat of the second object to be cooled in at least one of the first evaporation unit and the second evaporation unit can flow into the accumulator. The accumulator can store a surplus refrigerant for the cycle.

As a result, the refrigeration cycle device can be operated stably, and the first evaporation unit and the second evaporation unit can surely exhibit cooling capacity.

Because the first switching unit is provided, the first circulation mode and the first bypass circulation mode can be switched. Similarly, because the second switching unit is provided, the second circulation mode and the second bypass circulation mode can be switched.

Accordingly, the refrigerant flowing out of the first evaporation unit can be drawn into the compressor while bypassing the accumulator. The refrigerant flowing out of the second evaporation unit can be drawn into the compressor while bypassing the accumulator. As a result, the cooling capacity of any evaporation unit can be adjusted.

Furthermore, the flow rate of the refrigerant flowing through the accumulator can be reduced to reduce the pressure loss generated in the refrigerant when flowing through the accumulator. As a result, the pressure of the suction refrigerant can be increased to increase the discharge flow rate of the compressor, so that the cooling capacity exhibited in the evaporation unit can be increased.

That is, according to the refrigeration cycle device of the first aspect, the evaporation unit can exhibit an appropriate cooling capacity.

Here, the energy flow can be defined as a flow of energy when energy is transmitted.

A refrigeration cycle device according to a second aspect of the present disclosure includes a first evaporation unit and a second evaporation unit, an accumulator, and a compressor.

The first evaporation unit and a second evaporation unit are configured to evaporate a refrigerant circulating in a refrigerant circuit, and are connected in parallel to a flow of the refrigerant. The accumulator is configured to separate the refrigerant flowing out of at least one of the first evaporation unit and the second evaporation unit into gas and liquid, and to store a surplus refrigerant. The compressor is configured to draw and compress a gas refrigerant separated in the accumulator.

The refrigeration cycle device is further provided with a bypass passage and a refrigerant circuit switching unit.

The bypass passage is configured to guide at least one of the refrigerant flowing out of the first evaporation unit and the refrigerant flowing out of the second evaporation unit to a suction port of the compressor while bypassing the accumulator. The refrigerant circuit switching unit is configured to switch a refrigerant cycle in which at least one of the refrigerant flowing out of the first evaporation unit and the refrigerant flowing out of the second evaporation unit flows into the accumulator.

Accordingly, the refrigerant circuit switching unit is switched to the refrigerant cycle in which at least one of the refrigerant flowing out of the first evaporation unit and the refrigerant flowing out of the second evaporation unit flows into the accumulator. Therefore, the accumulator can store the surplus refrigerant for the cycle.

As a result, the refrigeration cycle device can be operated stably, and the first evaporation unit and the second evaporation unit can surely exert the cooling capacity. That is, according to the refrigeration cycle device of the second aspect of the present disclosure, the evaporation unit can exhibit an appropriate cooling capacity.

A refrigeration cycle device according to a third aspect of the present disclosure includes a first evaporation unit and a second evaporation unit, an accumulator, a compressor, and a bypass passage.

The first evaporation unit and a second evaporation unit are configured to evaporate a refrigerant circulating in a refrigerant circuit. The first evaporation unit and the second evaporation unit are connected in parallel to a flow of the refrigerant. The accumulator is configured to separate the refrigerant flowing out of the first evaporation unit into gas and liquid to store a surplus refrigerant. The compressor is configured to draw and compress a gas refrigerant separated in the accumulator. The bypass passage is provided through which the refrigerant flowing out of the second evaporation unit flows to a suction port of the compressor while bypassing the accumulator.

Furthermore, the refrigeration cycle device is provided with a heat medium circuit and a heat medium circuit switching unit.

The heat medium circuit is configured to circulate a heat medium that conveys heat of a first object to be cooled and heat of a second object to be cooled. The heat medium circuit switching unit is configured to switch a heat medium circuit in which heat is exchanged between the heat medium having heat-absorbed from at least one of the first object to be cooled and the second object to be cooled, and the refrigerant flowing through the first evaporation unit.

Accordingly, the heat medium circuit switching unit switches to the heat medium circuit in which heat is exchanged between the heat medium that has absorbed at least one of the heat of the first object to be cooled and the heat of the second object to be cooled, and the refrigerant flowing through the first evaporation unit. Therefore, the refrigerant that exchanges heat with the heat medium by the first evaporation unit can flow into the accumulator. Furthermore, the accumulator can store a surplus refrigerant for the cycle.

As a result, the refrigeration cycle device can be operated stably, and the first evaporation unit can surely exert the cooling capacity. That is, according to the refrigeration cycle device of the third aspect of the present disclosure, the evaporation unit can exhibit an appropriate cooling capacity.

Hereinafter, a plurality of embodiments for carrying out the present disclosure will be described with reference to the drawings. In each embodiment, parts corresponding to matters described in the preceding embodiment are denoted by the same reference numerals, and redundant description may be omitted. In a case where only part of the configuration is described in each embodiment, other embodiments described above can be applied to other parts of the configuration. It is possible to not only combine portions specifically indicating that combinations are possible in the respective embodiments, but also partially combine the embodiments even if it is not explicitly described unless there is a problem in the combination.

First Embodiment

The first embodiment of a refrigeration cycle device according to the present disclosure will be described with reference to FIGS. 1 to 6. A refrigeration cycle device 1 of the present embodiment is applied to an air conditioner with a device cooling function having both a function of air-conditioning the space to be air conditioned and a function of cooling a device to be cooled 70. Therefore, the first object to be cooled in the refrigeration cycle device 1 is ventilation air blown to the space to be air conditioned. The second object to be cooled in the refrigeration cycle device 1 is the device to be cooled 70.

As shown in the overall configuration diagram of FIG. 1, the refrigeration cycle device 1 includes a vapor compression type refrigerant circuit 10, a heat medium circuit 30, a control device 50, and the like.

First, the refrigerant circuit 10 will be described. The refrigerant circuit 10 forms a vapor compression refrigeration cycle that cools the ventilation air blown into the space to be air conditioned and the heat medium circulating in the heat medium circuit 30.

In the refrigerant circuit 10, an HFO refrigerant (specifically, R1234yf) is used as the refrigerant. The refrigerant circuit 10 has a subcritical refrigeration cycle in which the pressure of the high-pressure side refrigerant does not exceed the critical pressure of the refrigerant. Refrigerating machine oil for lubricating a compressor 11 is mixed in the refrigerant. The refrigerating machine oil is a PAG oil having compatibility with a liquid refrigerant. Part of the refrigerating machine oil circulates through the refrigerant circuit 10 together with the refrigerant.

The compressor 11 sucks, compresses, and discharges the refrigerant in the refrigerant circuit 10. The compressor 11 is an electric compressor whose refrigerant discharge capacity (that is, the number of rotations) is controlled by a control signal output from the control device 50 described later.

A refrigerant inlet of a radiator 12 is connected to a discharge port of the compressor 11. The radiator 12 is disposed outside the space to be air conditioned. The radiator 12 is a heat radiating heat exchange unit that exchanges heat between the discharge refrigerant discharged from compressor 11 and outside air blown by an outside air fan 12*a*. The radiator 12 radiates heat of the discharge refrigerant to the outside air to condense the discharge refrigerant. Therefore, the radiator 12 is a heat exchange unit for condensation.

The outside air fan 12*a* is an electric blower whose blowing capacity (that is, the number of rotations) is controlled by a control voltage output from the control device 50.

The flow inlet port of a first three-way joint 13*a* is connected to an outlet of the radiator 12. The first three-way joint 13*a* has three flow inlet/outlet ports communicating with each other. As the first three-way joint 13*a*, a joint formed by joining a plurality of pipes or a joint formed by providing a plurality of refrigerant passages in a metal block or a resin block can be used.

The refrigerant circuit 10 further includes a second three-way joint 13*b* to a fourth three-way joint 13*d* as described later. The basic configuration of each of the second three-way joint 13*b* to the fourth three-way joint 13*d* is similar to that of the first three-way joint 13*a*.

These three-way joints branch the flow of the refrigerant when one of the three flow inlet/outlet ports is used as the flow inlet port and the remaining two are used as the flow outlet port. When two of the three flow inlet/outlet ports are used as the flow inlet port and the remaining one is used as the flow outlet port, the flows of the refrigerant are merged.

The inlet of a first expansion valve 14*a* is connected to one flow outlet port of the first three-way joint 13*a*. The refrigerant inlet of a air-cooling evaporator 15 is connected to the outlet of the first expansion valve 14*a*.

The first expansion valve 14*a* is the air-cooling evaporator side decompression unit that decompresses the refrigerant flowing out of one flow outlet port of the first three-way joint 13*a* when cooling the ventilation air blown into the space to be air conditioned. The first expansion valve 14*a* is a first flow rate adjustment unit that adjusts a flow rate (in the present embodiment, the mass flow rate) of the refrigerant flowing through the air-cooling evaporator 15.

The first expansion valve 14*a* is an electric variable throttle mechanism including a valve body portion that changes a throttle opening and an electric actuator as a drive unit that displaces the valve body portion. The operation of the first expansion valve 14*a* is controlled by a control signal output from the control device 50. The first expansion valve 14*a* has a full-close function of closing the refrigerant passage by setting the throttle opening to a fully closed state.

The air-cooling evaporator 15 is a first evaporation unit that exchanges heat between the low pressure refrigerant decompressed by the first expansion valve 14*a* and the ventilation air blown from the indoor blower 15*a*. The air-cooling evaporator 15 cools the ventilation air by evaporating the low pressure refrigerant to exert a heat absorbing action. An indoor blower 15*a* is an electric blower whose blowing capacity (that is, the number of rotations) is controlled by a control voltage output from the control device 50.

The flow inlet port of a first three-way valve 16*a* is connected to the refrigerant outlet of the air-cooling evaporator 15. The first three-way valve 16*a* is a three-way flow rate regulating valve capable of continuously adjusting the flow rate ratio between the flow rate of the refrigerant flowing out to the one flow inlet port of the second three-way joint 13*b* and the flow rate of the refrigerant flowing out to the one flow inlet port of a fourth three-way joint 13*d*. The operation of the first three-way valve 16*a* is controlled by a control signal output from the control device 50.

The inlet of a second expansion valve 14*b* is connected to the other flow outlet port of the first three-way joint 13*a*. The refrigerant inlet of a chiller 17 is connected to the outlet of the second expansion valve 14*b*.

The second expansion valve 14*b* is a chiller-side decompression unit that decompresses the refrigerant flowing out of the other flow outlet port of the first three-way joint 13*a* when cooling the heat medium circulating in the heat medium circuit 30. The second expansion valve 14*b* is a second flow rate adjustment unit that adjusts a flow rate (in the present embodiment, the mass flow rate) of the refrigerant flowing through the chiller 17. The basic configuration of each of the second expansion valve 14*b* is similar to that of the first expansion valve 14*a*. Therefore, the second expansion valve 14*b* also has a full-close function.

The chiller 17 is a second evaporation unit that exchanges heat between the low pressure refrigerant decompressed by the second expansion valve 14*b* and the heat medium pressure-fed from a heat medium pump 31. The chiller 17 cools the heat medium by evaporating the low pressure refrigerant to exert a heat absorbing action.

The flow inlet port of a second three-way valve 16*b* is connected to the refrigerant outlet of the chiller 17. The second three-way valve 16*b* is a three-way flow rate regulating valve capable of continuously adjusting the flow rate ratio between the flow rate of the refrigerant flowing out to the other flow inlet port of the second three-way joint 13*b* and the flow rate of the refrigerant flowing out to the one flow inlet port of a third three-way joint 13*c*. The basic configuration of each of the second three-way valve 16*b* is similar to that of the first three-way valve 16*a*.

The inlet of an accumulator 18 is connected to the flow outlet port of the second three-way joint 13*b*. The accumulator 18 is a low-pressure gas-liquid separator that separates the refrigerant flowing into the accumulator into gas and liquid, and stores the separated refrigerant as a surplus refrigerant in the cycle.

The other flow inlet port of the third three-way joint 13*c* is connected to the gas refrigerant outlet of the accumulator 18. The other inlet of the fourth three-way joint 13*d* is connected to the flow outlet port of the third three-wayjoint 13*c*. The suction port of the compressor 11 is connected to the flow outlet port of the fourth three-way joint 13*d*.

As apparent from the above description, the air-cooling evaporator 15 and the chiller 17 are connected in parallel to the refrigerant flow. When the first three-way valve 16*a* causes the refrigerant to flow out toward the second three-way joint 13*b*, the refrigerant flowing out of the air-cooling evaporator 15 can flow into the accumulator 18. When the first three-way valve 16*a* causes the refrigerant to flow out toward the fourth three-way joint 13*d*, the refrigerant flowing out of the air-cooling evaporator 15 can bypass the accumulator 18 and be guided toward the suction port of the compressor 11.

Therefore, the first three-way valve 16*a* is a refrigerant circuit switching unit. The refrigerant passage connecting the first three-way valve 16*a* and the fourth three-way joint 13*d* forms a bypass passage. The refrigerant passage that bypasses the accumulator 18 and is guided to the refrigerant to the suction port of the compressor 11 from the first three-way valve 16*a* is a first bypass passage 19*a*.

When the second three-way valve 16*b* causes the refrigerant to flow out toward the second three-way joint 13*b*, the refrigerant flowing out of the chiller 17 can flow into the accumulator 18. When the second three-way valve 16*b* causes the refrigerant to flow out toward the third three-way joint 13*c*, the refrigerant flowing out of the chiller 17 can bypass the accumulator 18 and be guided to the suction port of the compressor 11.

Accordingly, second three-way valve 16*b* is a refrigerant circuit switching unit. The refrigerant passage connecting the second three-way valve 16*b* and the third three-way joint 13*c* forms a bypass passage. A refrigerant passage that bypasses the accumulator 18 and is guided to the suction port of the compressor 11 from the second three-way valve 16*b* is a second bypass passage 19*b*.

Next, the heat medium circuit 30 will be described. The heat medium circuit 30 is a circuit that circulates the heat medium. In the present embodiment, an ethylene glycol aqueous solution is employed as the heat medium. In the heat medium circuit 30, the heat medium pump 31, a cooling water passage 70*a* formed in the device to be cooled 70, the heat medium passage of the chiller 17, and the like are connected.

The heat medium pump 31 is a heat medium pressure feeding unit that pressure-feeds the heat medium flowing out from the cooling water passage 70*a* of the device to be cooled 70 to the inlet of the heat medium passage of the chiller 17. The heat medium pump 31 is an electric water pump whose rotation speed (that is, the pressure feeding capability) is controlled by a control voltage output from the control device 50.

The inlet of the cooling water passage 70*a* of the device to be cooled 70 is connected to the outlet of the heat medium passage of the chiller 17. The cooling water passage 70*a* is a cooling water passage formed to cool the device to be cooled 70 by circulating the heat medium cooled by the chiller 17.

Next, an outline of the electric control unit of the refrigeration cycle device 1 will be described. The control device 50 includes a microcomputer including a CPU, a ROM, a RAM, and the like, and peripheral circuits thereof. The control device 50 performs various calculations and processes based on a control program stored in the ROM. The control device 50 controls the operations of the various devices to be controlled 11, 14*a*, 14*b*, 16*a*, 16*b*, 31, and the like connected to the output side based on the calculation and processing results.

A control sensor group 51 for controlling various devices to be controlled is connected to the input of the control device 50. Various detection signals detected by the sensor group 51 are input to the control device 50. The control sensor group 51 includes a high-pressure temperature pressure sensor, a first evaporator temperature pressure sensor, a second evaporator temperature pressure sensor, an inside air temperature sensor, a device temperature sensor, a heat medium temperature sensor, and the like.

The high-pressure temperature pressure sensor is a high-pressure temperature pressure detection unit that detects a discharge refrigerant temperature Td that is a temperature of a discharge refrigerant discharged from the compressor 11 and a pressure. The first evaporator temperature pressure sensor is a first evaporator temperature pressure detection unit that detects the temperature and the pressure of the outlet refrigerant of the air-cooling evaporator 15. The second evaporator temperature pressure sensor is a second evaporator temperature pressure detection unit that detects the temperature and the pressure of the outlet refrigerant of the chiller 17.

The inside air temperature sensor is an inside air temperature detection unit that detects the temperature of the space to be air conditioned. The device temperature sensor is a device temperature detection unit that detects the temperature of the device to be cooled 70. The heat medium temperature sensor is a heat medium temperature detection unit that detects a heat medium temperature TW which is the temperature of the heat medium flowing into the chiller 17.

Furthermore, an operation unit is connected to an input of the control device 50 in a wired or wireless manner. An operation signal output from the operation unit is input to the control device 50. The operation unit is provided with various operation switches operated by the user. The various operation switches include an operation switch for requesting an operation of the refrigeration cycle device 1, a mode selector switch for setting an operation mode, and the like.

The control device 50 includes a plurality of control units integrally configured to control various devices to be controlled connected to an output side thereof. That is, in the control device 50, a configuration (hardware and software) that controls the operation of each device to be controlled has a control unit that controls the operation of each device to be controlled.

For example, in the control device 50, the configuration that controls the refrigerant discharge capacity of the compressor 11 is a discharge capacity control unit 50*a*. The configuration that controls the operations of the first three-way valve 16*a* and the second three-way valve 16*b*, which are refrigerant circuit switching units, is a refrigerant circuit control unit 50*b*. In FIG. 1, for clarity of illustration, part of a power line, a signal line, or the like connecting the control device 50 and the device to be controlled is omitted.

Next, the operation of the refrigeration cycle device 1 having the above configuration according to the present embodiment will be described. In the refrigeration cycle device 1, various operation modes are switched in order to cool the ventilation air and the device to be cooled 70. Switching of the operation mode is performed by executing a control program stored in advance in the control device 50. When the user sets the operation mode by the mode selector switch of the operation unit, the operation mode set by the user is prioritized. The detailed operation of each operation mode will be described below.

(a) First Cooling Mode

The first cooling mode is an operation mode for cooling only the ventilation air as the first object to be cooled. In the first cooling mode, the control device 50 brings the first expansion valve 14*a* into the throttling state where the pressure reducing action is exerted, and brings the second expansion valve 14*b* into the fully closed state.

The control device 50 controls the operation of the first three-way valve 16*a* so that the entire flow rate of the refrigerant flowing out of the air-cooling evaporator 15 flows into the accumulator 18.

The control device 50 controls the operation of the second three-way valve 16*b* so that the amount of the refrigerant flowing out of the chiller 17 bypasses the accumulator 18 and is guided to the suction port of the compressor 11. In the first cooling mode, since the second expansion valve 14*b* is in the fully closed state, the refrigerant does not flow out of the chiller 17.

Figure 2:
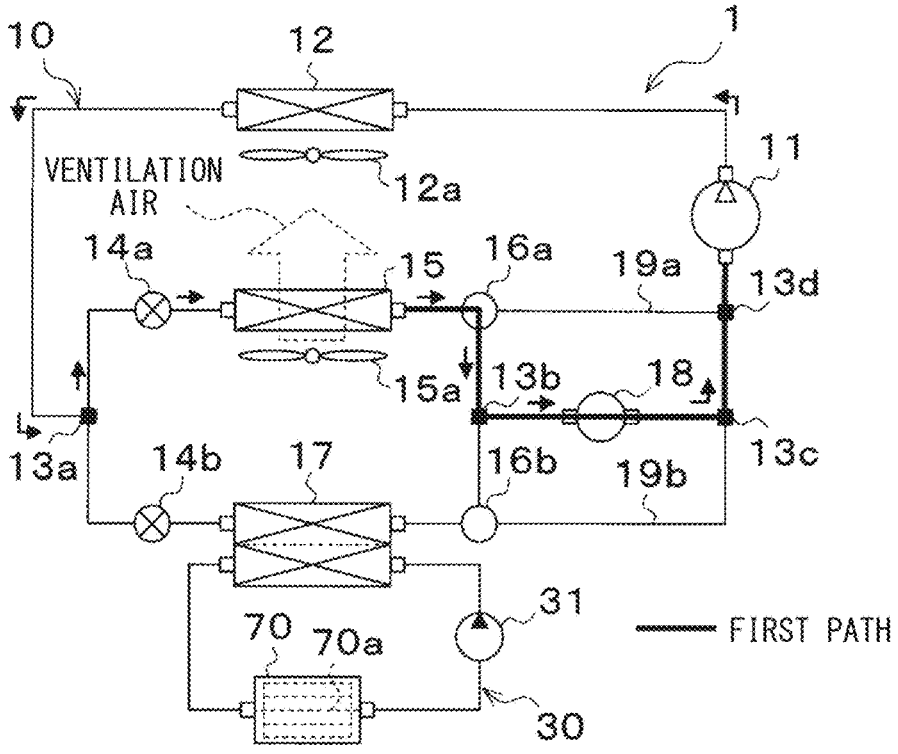
FIG. 2 is a schematic overall configuration diagram illustrating a flow and the like of a refrigerant in a first cooling mode of the refrigeration cycle device according to the first embodiment.

Therefore, as indicated by solid arrows in FIG. 2, the refrigerant circuit 10 in the first cooling mode is switched to a refrigerant circuit in which the refrigerant discharged from the compressor 11 circulates through the radiator 12, the first expansion valve 14*a*, the air-cooling evaporator 15, the first three-way valve 16*a*, the accumulator 18, and the suction port of the compressor 11 in this order.

The control device 50 operates the indoor blower 15*a*. The control device 50 appropriately controls the operations of the various devices to be controlled so that the temperature of the ventilation air is an appropriate temperature for air-cooling the space to be air conditioned.

Therefore, in the refrigerant circuit 10 in the first cooling mode, a vapor compression refrigeration cycle is configured in which the radiator 12 functions as a condenser that radiates heat to condense the refrigerant and the air-cooling evaporator 15 functions as an evaporator that evaporates the refrigerant. In the air-cooling evaporator 15, the ventilation air is cooled.

As a result, in the refrigeration cycle device 1 in the first cooling mode, the ventilation air cooled by the air-cooling evaporator 15 is blown out into the space to be air conditioned, thereby air-cooling the space to be air conditioned.

In FIG. 2, the first path is indicated by a thick solid line. The first path is a path of an energy flow in which the heat of the ventilation air as the first object to be cooled moves to the suction refrigerant drawn into the compressor 11. The energy flow can be defined as a flow of energy when energy is transmitted.

In the refrigeration cycle device 1, the accumulator 18 is disposed in the first path. The first bypass passage 19*a* serves as a first bypass path. The first three-way valve 16*a* is a first switching unit capable of adjusting a heat quantity ratio of the amount of heat flowing into the first bypass passage 19*a* to the amount of heat (that is, the amount of energy) flowing into the accumulator 18 in the heat of the first object to be cooled. In the first cooling mode, the first three-way valve 16*a* switches a mode to the first circulation mode.

(b) Second Cooling Mode

The second cooling mode is an operation mode for cooling only the device to be cooled 70 that is the second object to be cooled. In the second cooling mode, the control device 50 brings the first expansion valve 14*a* into the fully closed state and brings the second expansion valve 14*b* into the throttling state.

Further, the control device 50 controls the operation of the second three-way valve 16*b* so that the entire flow rate of the refrigerant flowing out of the chiller 17 flows into the accumulator 18.

The control device 50 controls the operation of the first three-way valve 16*a* so that the refrigerant flowing out of the air-cooling evaporator 15 bypasses the accumulator 18 and is guided to the suction port of the compressor 11. Since the first expansion valve 14*a* is in the fully closed state in the second cooling mode, the refrigerant does not flow out of the air-cooling evaporator 15.

Figure 3:
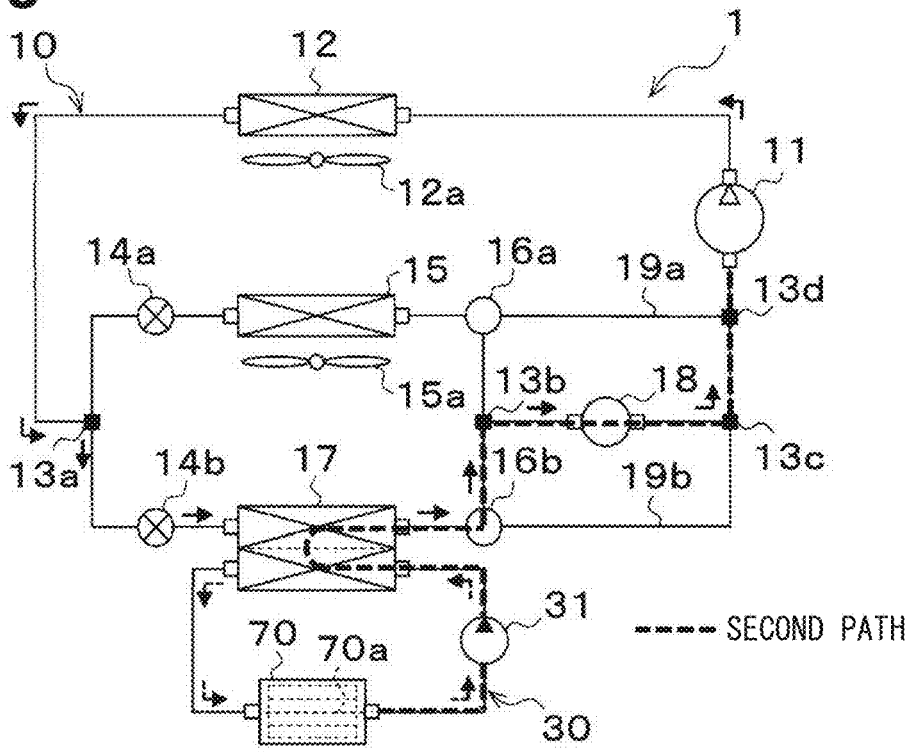
FIG. 3 is a schematic overall configuration diagram illustrating a flow and the like of a refrigerant in a second cooling mode of the refrigeration cycle device according to the first embodiment.

Therefore, as indicated by solid arrows in FIG. 3, the refrigerant circuit 10 in the second cooling mode is switched to a refrigerant circuit in which the refrigerant discharged from the compressor 11 circulates through the radiator 12, the second expansion valve 14*b*, the chiller 17, the second three-way valve 16*b*, the accumulator 18, and the suction port of the compressor 11 in this order.

The control device 50 operates the heat medium pump 31. In addition, the control device 50 appropriately controls the operations of the various devices to be controlled so that the temperature of the device to be cooled 70 is an appropriate temperature.

Therefore, in the refrigerant circuit 10 in the second cooling mode, a vapor compression refrigeration cycle is configured in which the radiator 12 functions as a condenser and the chiller 17 functions as an evaporator. In the chiller 17, the heat medium is cooled. In the heat medium circuit 30 in the second cooling mode, as indicated by the broken arrow in FIG. 3, the heat medium flowing out of the heat medium passage of the chiller 17 is pressure-fed to the cooling water passage 70*a* of the device to be cooled 70.

As a result, in the refrigeration cycle device 1 in the second cooling mode, the heat medium cooled by the chiller 17 flows through the cooling water passage 70*a* of the device to be cooled 70, whereby the device to be cooled 70 is cooled.

In FIG. 3, the second path is indicated by a thick broken line. The second path is a path of an energy flow in which the heat of the device to be cooled 70 as the second object to be cooled moves to the suction refrigerant.

In the refrigeration cycle device 1, the accumulator 18 is disposed in the second path. The second bypass passage 19*b* serves as a second bypass path. The second three-way valve 16*b* is a second switching unit capable of adjusting a heat quantity ratio of the amount of heat flowing into the second bypass passage 19*b* to the amount of heat flowing into the accumulator 18 in the heat of the second object to be cooled. In the second cooling mode, the second three-way valve 16*b* switches a mode to the second circulation mode.

(c) Composite Cooling Mode

The composite cooling mode is an operation mode for cooling both the ventilation air and the device to be cooled 70. The composite cooling mode includes (c-1) a first composite cooling mode, (c-2) a second composite cooling mode, and (c-3) a third composite cooling mode.

(c-1) First Composite Cooling Mode

The first composite cooling mode is selected when, by switching the circuit configuration of the refrigerant circuit 10, the outlet refrigerant of the chiller 17 has an enthalpy higher than that of the outlet refrigerant of the air-cooling evaporator 15, and the outlet refrigerant of the chiller 17 is a gas refrigerant having a degree of superheat.

In the refrigerant circuit 10 in the first composite cooling mode, the control device 50 brings the first expansion valve 14*a* into the throttling state and brings the second expansion valve 14*b* into the throttling state.

The control device 50 controls the operation of the first three-way valve 16*a* so that the refrigerant flowing out of the air-cooling evaporator 15 flows into the accumulator 18. The control device 50 controls the operation of the second three-way valve 16*b* so that the refrigerant flowing out of the chiller 17 bypasses the accumulator 18 and is guided to the suction port of the compressor 11.

Figure 4:
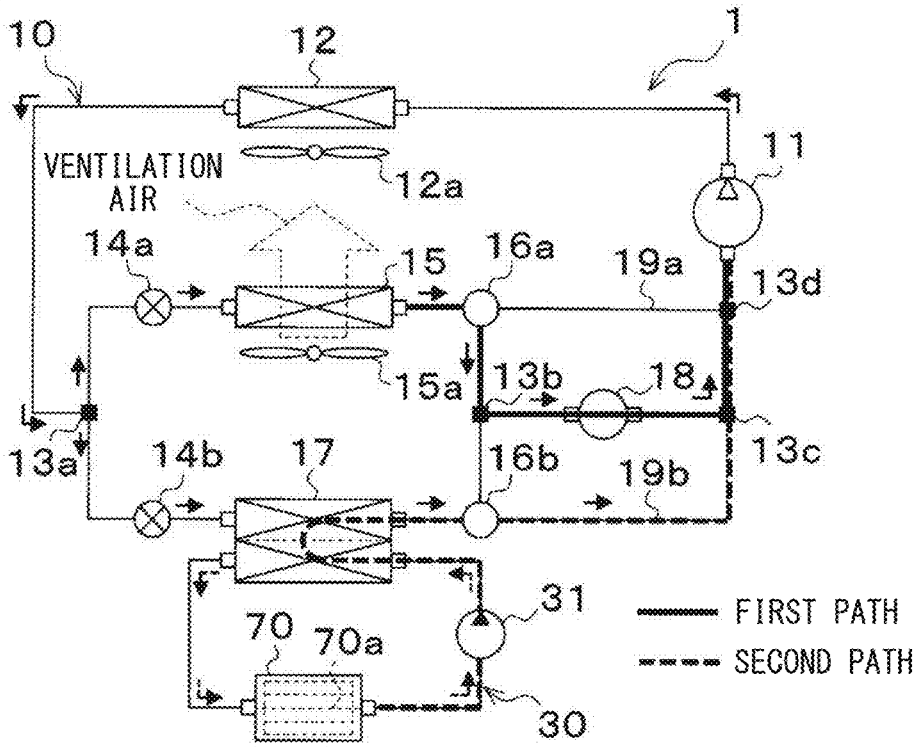
FIG. 4 is a schematic overall configuration diagram illustrating a flow and the like of a refrigerant in a first composite cooling mode of the refrigeration cycle device according to the first embodiment.

Therefore, in the refrigerant circuit 10 in the first composite cooling mode, as indicated by solid arrows in FIG. 4, the refrigerant discharged from the compressor 11 circulates through the radiator 12, the first expansion valve 14*a*, the air-cooling evaporator 15, the first three-way valve 16*a*, the accumulator 18, and the suction port of the compressor 11 in this order. At the same time, the circuit is switched to a refrigerant circuit in which the refrigerant discharged from the compressor 11 circulates through the radiator 12, the second expansion valve 14*b*, the chiller 17, the second three-way valve 16*b*, and the suction port of the compressor 11 in this order.

The control device 50 operates the indoor blower 15*a*. The control device 50 operates the heat medium pump 31. The control device 50 appropriately controls the operations of the various devices to be controlled so that the temperature of the ventilation air is an appropriate temperature for air-cooling the space to be air conditioned and the temperature of the device to be cooled 70 is an appropriate temperature.

Therefore, in the refrigerant circuit 10 in the first composite cooling mode, a vapor compression refrigeration cycle is configured in which the radiator 12 functions as a condenser and the air-cooling evaporator 15 and the chiller 17 function as evaporators. In the air-cooling evaporator 15, the ventilation air is cooled. In the chiller 17, the heat medium is cooled.

In the heat medium circuit 30 in the first composite cooling mode, as indicated by the broken arrow in FIG. 4, the heat medium flowing out of the heat medium passage of the chiller 17 is pressure-fed to the cooling water passage 70*a* of the device to be cooled 70.

As a result, in the refrigeration cycle device 1 in the first composite cooling mode, the ventilation air cooled by the air-cooling evaporator 15 is blown out into the space to be air conditioned, thereby air-cooling the space to be air conditioned. The heat medium cooled by the chiller 17 flows through the cooling water passage 70*a* of the device to be cooled 70, whereby the device to be cooled 70 is cooled.

In FIG. 4, the first path is indicated by a thick solid line, and the second path is indicated by a thick broken line. In the first composite cooling mode, the first three-way valve 16*a* switches a mode to the first circulation mode. Further, in the first composite cooling mode, the second three-way valve 16*b* switches a mode to the second bypass circulation mode.

In the first composite cooling mode, the refrigerant flowing out of the air-cooling evaporator 15 flows into the accumulator 18, and the gas refrigerant having the degree of superheat and flowing out of the chiller 17 bypasses the accumulator 18 and is guided to the suction port of the compressor 11. Accordingly, in the first composite cooling mode, the enthalpy difference obtained by subtracting the enthalpy of the inlet refrigerant from the enthalpy of the outlet refrigerant of the chiller 17 is increased, and the cooling capacity of the chiller 17 can be increased.

(c-2) Second Composite Cooling Mode

The second composite cooling mode is selected when, by switching the circuit configuration of the refrigerant circuit 10, the enthalpy of the outlet refrigerant of the air-cooling evaporator 15 is higher than the enthalpy of the outlet refrigerant of the chiller 17, and the outlet refrigerant of the air-cooling evaporator 15 is a gas refrigerant having a degree of superheat.

In the refrigerant circuit 10 in the second composite cooling mode, the control device 50 brings the first expansion valve 14*a* into the throttling state and brings the second expansion valve 14*b* into the throttling state.

The control device 50 controls the operation of the first three-way valve 16*a* so that the refrigerant flowing out of the air-cooling evaporator 15 bypasses the accumulator 18 and is guided to the suction port of the compressor 11. The control device 50 controls the operation of the second three-way valve 16*b* so that the refrigerant flowing out of the chiller 17 flows into the accumulator 18.

Figure 5:
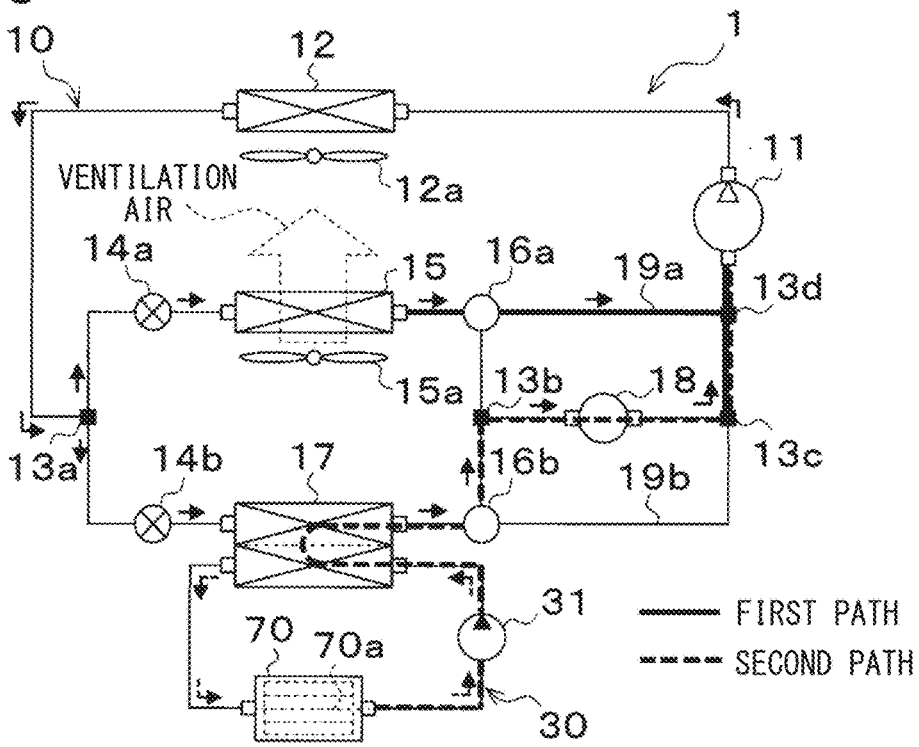
FIG. 5 is a schematic overall configuration diagram illustrating a flow and the like of a refrigerant in a second composite cooling mode of the refrigeration cycle device according to the first embodiment.

Therefore, in the refrigerant circuit 10 in the second composite cooling mode, as indicated by solid arrows in FIG. 5, the refrigerant discharged from the compressor 11 circulates through the radiator 12, the first expansion valve 14*a*, the air-cooling evaporator 15, the first three-way valve 16*a*, and the suction port of the compressor 11 in this order. At the same time, the circuit is switched to a refrigerant circuit in which the refrigerant discharged from the compressor 11 circulates through the radiator 12, the second expansion valve 14*b*, the chiller 17, the second three-way valve 16*b*, the accumulator 18, and the suction port of the compressor 11 in this order.

The control device 50 operates the indoor blower 15*a*. The control device 50 operates the heat medium pump 31. The control device 50 appropriately controls the operations of the various devices to be controlled so that the temperature of the ventilation air is an appropriate temperature for air-cooling the space to be air conditioned and the temperature of the device to be cooled 70 is an appropriate temperature.

Therefore, in the refrigerant circuit 10 in the second composite cooling mode, a vapor compression refrigeration cycle is configured in which the radiator 12 functions as a condenser and the air-cooling evaporator 15 and the chiller 17 function as evaporators. In the air-cooling evaporator 15, the ventilation air is cooled. In the chiller 17, the heat medium is cooled.

In the heat medium circuit 30 in the second composite cooling mode, as indicated by the broken arrow in FIG. 5, the heat medium flowing out of the heat medium passage of the chiller 17 is pressure-fed to the cooling water passage 70*a* of the device to be cooled 70.

As a result, in the refrigeration cycle device 1 in the second composite cooling mode, the ventilation air cooled by the air-cooling evaporator 15 is blown out into the space to be air conditioned, thereby air-cooling the space to be air conditioned. The heat medium cooled by the chiller 17 flows through the cooling water passage 70*a* of the device to be cooled 70, whereby the device to be cooled 70 is cooled.

In FIG. 5, the first path is indicated by a thick solid line, and the second path is indicated by a thick broken line. In the second composite cooling mode, the first three-way valve 16*a* switches a mode to the first bypass circulation mode. Further, in the second composite cooling mode, the second three-way valve 16*b* switches a mode to the second circulation mode.

In the second composite cooling mode, the refrigerant flowing out of the chiller 17 flows into the accumulator 18, and the gas refrigerant having the degree of superheat and flowing out of the air-cooling evaporator 15 bypasses the accumulator 18 and is guided to the suction port of the compressor 11. Accordingly, in the second composite cooling mode, the enthalpy difference obtained by subtracting the enthalpy of the inlet refrigerant from the enthalpy of the outlet refrigerant of the air-cooling evaporator 15 is increased, and the cooling capacity of the air-cooling evaporator 15 can be increased.

(c-3) Third Composite Cooling Mode

The third composite cooling mode is a composite cooling mode selected when the first composite cooling mode and the second composite cooling mode are not selected. In the refrigerant circuit 10 in the third composite cooling mode, the control device 50 brings the first expansion valve 14*a* into the throttling state and brings the second expansion valve 14*b* into the throttling state.

The control device 50 controls the operation of the first three-way valve 16*a* so that the refrigerant flowing out of the air-cooling evaporator 15 flows into the accumulator 18. The control device 50 controls the operation of the second three-way valve 16*b* so that the refrigerant flowing out of the chiller 17 flows into the accumulator 18.

Figure 6:
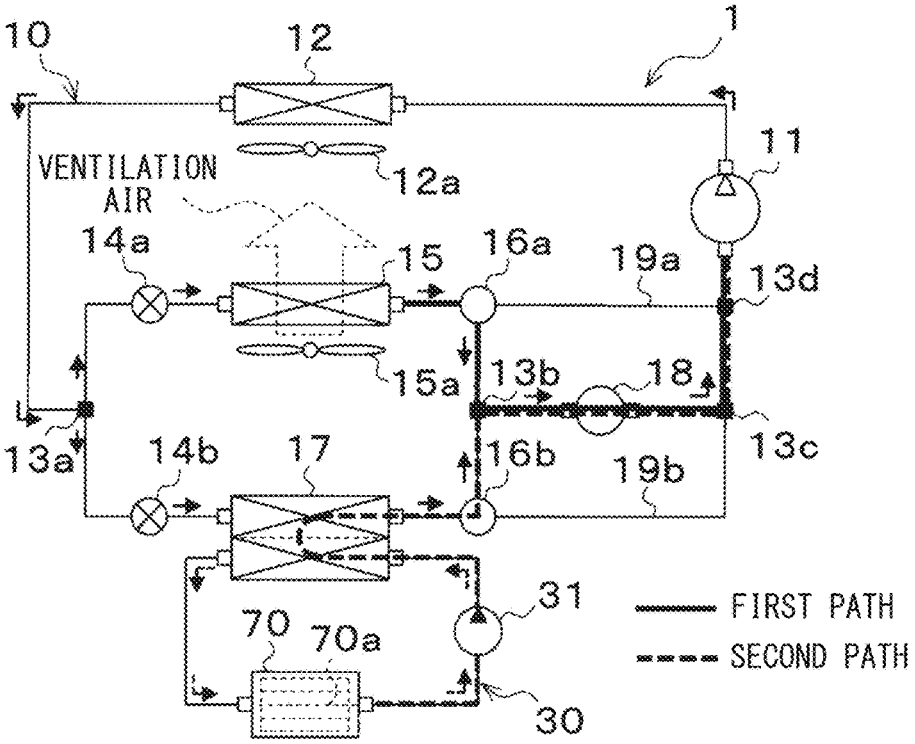
FIG. 6 is a schematic overall configuration diagram illustrating a flow and the like of a refrigerant in a third composite cooling mode of the refrigeration cycle device according to the first embodiment.

Therefore, in the refrigerant circuit 10 in the third composite cooling mode, as indicated by solid arrows in FIG. 6, the refrigerant discharged from the compressor 11 circulates through the radiator 12, the first expansion valve 14*a*, the air-cooling evaporator 15, the first three-way valve 16*a*, the accumulator 18, and the suction port of the compressor 11 in this order. At the same time, the circuit is switched to a refrigerant circuit in which the refrigerant discharged from the compressor 11 circulates through the radiator 12, the second expansion valve 14*b*, the chiller 17, the second three-way valve 16*b*, the accumulator 18, and the suction port of the compressor 11 in this order.

The control device 50 operates the indoor blower 15*a*. The control device 50 operates the heat medium pump 31. The control device 50 appropriately controls the operations of the various devices to be controlled so that the temperature of the ventilation air is an appropriate temperature for air-cooling the space to be air conditioned and the temperature of the device to be cooled 70 is an appropriate temperature.

Therefore, in the refrigerant circuit 10 in the third composite cooling mode, a vapor compression refrigeration cycle is configured in which the radiator 12 functions as a condenser and the air-cooling evaporator 15 and the chiller 17 function as evaporators. In the air-cooling evaporator 15, the ventilation air is cooled. In the chiller 17, the heat medium is cooled.

In the heat medium circuit 30 in the third composite cooling mode, as indicated by the broken arrow in FIG. 6, the heat medium flowing out of the heat medium passage of the chiller 17 is pressure-fed to the cooling water passage 70*a* of the device to be cooled 70.

As a result, in the refrigeration cycle device 1 in the third composite cooling mode, the ventilation air cooled by the air-cooling evaporator 15 is blown out into the space to be air conditioned, thereby air-cooling the space to be air conditioned. The heat medium cooled by the chiller 17 flows through the cooling water passage 70*a* of the device to be cooled 70, whereby the device to be cooled 70 is cooled.

In FIG. 6, the first path is indicated by a thick solid line, and the second path is indicated by a thick broken line. In the third composite cooling mode, the first three-way valve 16*a* switches a mode to the first circulation mode. Further, in the third composite cooling mode, the second three-way valve 16*b* switches a mode to the second circulation mode.

As described above, the refrigeration cycle device 1 according to the present embodiment can perform comfortable air-cooling of the space to be air conditioned and appropriate cooling of the device to be cooled 70 by switching the operation mode.

In the refrigeration cycle device including the plurality of evaporation units and the accumulator as in the refrigeration cycle device 1 of the present embodiment, when the refrigerant cannot flow into the accumulator 18 when the refrigerant circuit is switched, the surplus refrigerant cannot be stored. As a result, the refrigeration cycle device 1 cannot be operated stably, and the evaporator cannot exhibit cooling capacity.

Furthermore, in the refrigeration cycle device including the plurality of evaporation units for cooling the plurality of types of objects to be cooled, it is necessary to appropriately adjust the cooling capacity of each evaporation unit according to the temperature condition or the like of each object to be cooled.

On the other hand, in the refrigeration cycle device 1 of the present embodiment, the accumulator 18 is disposed in at least one of the first path and the second path in any operation mode. Therefore, at least one of the refrigerant that has absorbed heat of the ventilation air in the air-cooling evaporator 15 and the refrigerant that has absorbed heat of the refrigerant of the device to be cooled 70 in the chiller 17 can flow into the accumulator 18.

In other words, in the refrigeration cycle device 1 of the present embodiment, in any operation mode, first three-way valve 16*a* and second three-way valve 16*b* switch the refrigerant circuit as follows. That is, the refrigerant circuit is switched so that at least one of the refrigerant that has absorbed the heat of the ventilation air in the air-cooling evaporator 15 and the refrigerant that has absorbed the heat of the device to be cooled 70 in the chiller 17 can flow into the accumulator 18.

Accordingly, the accumulator 18 can store the surplus refrigerant of the cycle in any operation mode. As a result, the refrigeration cycle device 1 can be operated stably, and the air-cooling evaporator 15 and the chiller 17 can surely exert the cooling capacity.

In the refrigeration cycle device 1 according to the present embodiment, first three-way valve 16*a* can switch between the first circulation mode and the first bypass circulation mode. The second three-way valve 16*b* can switch between the second circulation mode and the second bypass circulation mode.

That is, switching can be performed so that any one path of the first path and the second path is a path through which energy passes through the accumulator 18, and the other path is a path where energy bypasses the accumulator 18.

Accordingly, as in the first composite cooling mode, the refrigerant flowing out of the chiller 17 can bypass the accumulator 18 and is drawn into the compressor 11. As in the second composite cooling mode, the refrigerant flowing out of the air-cooling evaporator 15 can bypass the accumulator 18 and is drawn into the compressor 11. Therefore, the cooling capacity can be adjusted for any evaporation unit of the air-cooling evaporator 15 and the chiller 17.

Furthermore, the flow rate of the refrigerant flowing through the accumulator 18 can be reduced to reduce the pressure loss generated when the refrigerant flows through the accumulator 18. As a result, since the pressure of the suction refrigerant can be increased and the discharge flow rate of the compressor 11 can be increased, the cooling capacity exhibited by the air-cooling evaporator 15 and the chiller 17 can be increased. As a result, the coefficient of performance (COP) of the refrigerant circuit 10 can be improved.

That is, in the refrigeration cycle device 1 of the present embodiment, the evaporation unit such as the air-cooling evaporator 15 and the chiller 17 can exhibit appropriate cooling capacity.

As described in (a) the first cooling mode and (b) the second cooling mode, the refrigeration cycle device 1 according to the present embodiment can cool only any one of the ventilation air and the device to be cooled 70. At this time, the first three-way valve 16*a* and the second three-way valve 16*b* switch the path of the energy flow so that the heat of one of the ventilation air and the device to be cooled 70 moves to the suction refrigerant via the accumulator 18.

In other words, the refrigeration cycle device 1 according to the present embodiment can execute the operation mode in which the refrigerant is supplied to one of the air-cooling evaporator 15 and the chiller 17 and the refrigerant is not supplied to the other of the air-cooling evaporator 15 and the chiller 17. At this time, the first three-way valve 16*a* and the second three-way valve 16*b* switch the refrigerant circuit so that the refrigerant flowing out of one evaporation unit of the air-cooling evaporator 15 and the chiller 17 flows into the accumulator 18.

As a result, even in the operation mode of cooling only one of the ventilation air and the device to be cooled 70, the surplus refrigerant for the cycle can be stored in the accumulator 18. As a result, the refrigeration cycle device 1 can be operated stably, and the air-cooling evaporator 15 or the chiller 17 can surely exert the cooling capacity.

As described in (c-1) the first composite cooling mode and (c-2) the second composite cooling mode, the refrigeration cycle device 1 according to the present embodiment can cool both the ventilation air and the device to be cooled 70. At this time, the first three-way valve 16*a* and the second three-way valve 16*b* switch the path of the energy flow so that the heat of one of the ventilation air and the device to be cooled 70 are moved to the suction refrigerant through the accumulator 18 and the heat of the other bypasses the accumulator 18 and is moved to the suction refrigerant.

In other words, in the refrigeration cycle device 1 according to the present embodiment, the first three-way valve 16*a* and the second three-way valve 16*b* can switch a circuit to a refrigerant circuit in which the refrigerant flowing out of the air-cooling evaporator 15 flows into the accumulator 18, and in which the refrigerant flowing out of the chiller 17 bypasses the accumulator 18 and is guided to the suction side of the compressor 11. Further, the circuit can be switched to a refrigerant circuit in which the refrigerant flowing out of the chiller 17 flows into the accumulator 18, and in which, at the same time, the refrigerant flowing out of the air-cooling evaporator 15 bypasses the accumulator 18 and is guided to the suction side of the compressor 11.

In addition, as described in (c-1) the first composite cooling mode and (c-2) the second composite cooling mode, in the refrigeration cycle device 1 according to the present embodiment, the first three-way valve 16*a* and the second three-way valve 16*b* guide the refrigerant that is the gas refrigerant having the higher enthalpy and the degree of superheat, of the outlet refrigerant of the air-cooling evaporator 15 and the outlet refrigerant of the chiller 17, to the suction port of the compressor with the refrigerant bypassing the accumulator 18.

Accordingly, the evaporation unit having the higher enthalpy of the outlet refrigerant can increase the enthalpy difference obtained by subtracting the enthalpy of the inlet refrigerant from the enthalpy of the outlet refrigerant to increase the cooling capacity. Furthermore, the flow rate of the refrigerant flowing through the accumulator 18 can be reduced, and the pressure loss generated when the refrigerant flows through the accumulator 18 can be effectively reduced.

As described in (c-3) the third composite cooling mode, the refrigeration cycle device 1 according to the present embodiment can cool both the ventilation air and the device to be cooled 70.

At this time, the first three-way valve 16*a* and the second three-way valve 16*b* cause both the refrigerant flowing out of the air-cooling evaporator 15 and the refrigerant flowing out of the chiller 17 to flow into the accumulator 18. Therefore, the surplus refrigerant for the cycle can be stored in the accumulator 18. As a result, the refrigeration cycle device 1 can be operated stably, and the air-cooling evaporator 15 and the chiller 17 can surely exert the cooling capacity.

A refrigeration cycle device 1*a* of the present embodiment may execute another operation mode in addition to the above-described operation mode.

For example, in the first cooling mode, the operation of the first three-way valve 16*a* may be controlled so that part of the refrigerant flowing out of the air-cooling evaporator 15 flows into the accumulator 18 and the remaining refrigerant flows into the first bypass passage 19*a*. At this time, the operation of the first three-way valve 16*a* may be controlled so that the air-cooling evaporator 15 exhibits appropriate cooling capacity, the surplus refrigerant is appropriately stored in the accumulator 18, and the pressure loss generated when the refrigerant flows through the accumulator 18 is reduced.

For example, in the second cooling mode, the operation of the second three-way valve 16*b* may be controlled so that part of the refrigerant flowing out of the chiller 17 flows into the accumulator 18 and the remaining refrigerant flows into the second bypass passage 19*b*. At this time, the operation of the second three-way valve 16*b* may be controlled so that the chiller 17 exerts appropriate cooling capacity, the surplus refrigerant is appropriately stored in the accumulator 18, and the pressure loss generated when the refrigerant flows through the accumulator 18 is reduced.

For example, in the first composite cooling mode and the second composite cooling mode, the first three-way valve 16*a* and the second three-way valve 16*b* may switch the path of the energy flow so that at least part of heat of one object to be cooled of the ventilation air and the device to be cooled 70 is moved via the accumulator 18 and at least part of heat of the other object to be cooled bypasses the accumulator 18 and is moved.

In other words, in the first composite cooling mode and the second composite cooling mode, the operation of the first three-way valve 16*a* may be controlled so that part of the refrigerant flowing out of the air-cooling evaporator 15 flows into the accumulator 18 and the remaining refrigerant flows into the first bypass passage 19*a*. In the first composite cooling mode and the second composite cooling mode, the operation of the second three-way valve 16*b* may be controlled so that part of the refrigerant flowing out of the chiller 17 flows into the accumulator 18 and the remaining refrigerant flows into the second bypass passage 19*b*.

More specifically, as a modification of the first composite cooling mode, the operation of the first three-way valve 16*a* is controlled so that part of the refrigerant flowing out of the air-cooling evaporator 15 flows into the accumulator 18 and the remaining refrigerant flows into the first bypass passage 19*a*. Further, the operation of the second three-way valve 16*b* may be controlled so that the entire flow rate of the refrigerant flowing out of the chiller 17 flows into the second bypass passage 19*b*.

At this time, the operation of the first three-way valve 16*a* may be controlled so that the air-cooling evaporator 15 or the chiller 17 exerts an appropriate cooling capacity, the surplus refrigerant is appropriately stored in the accumulator 18, and the pressure loss generated when the refrigerant flows through the accumulator 18 is reduced. The modification of the first composite cooling mode is effective when the cooling capacity of the heat medium required in the chiller 17 is higher than the cooling capacity required in the air-cooling evaporator 15.

Second Embodiment

Figure 7:
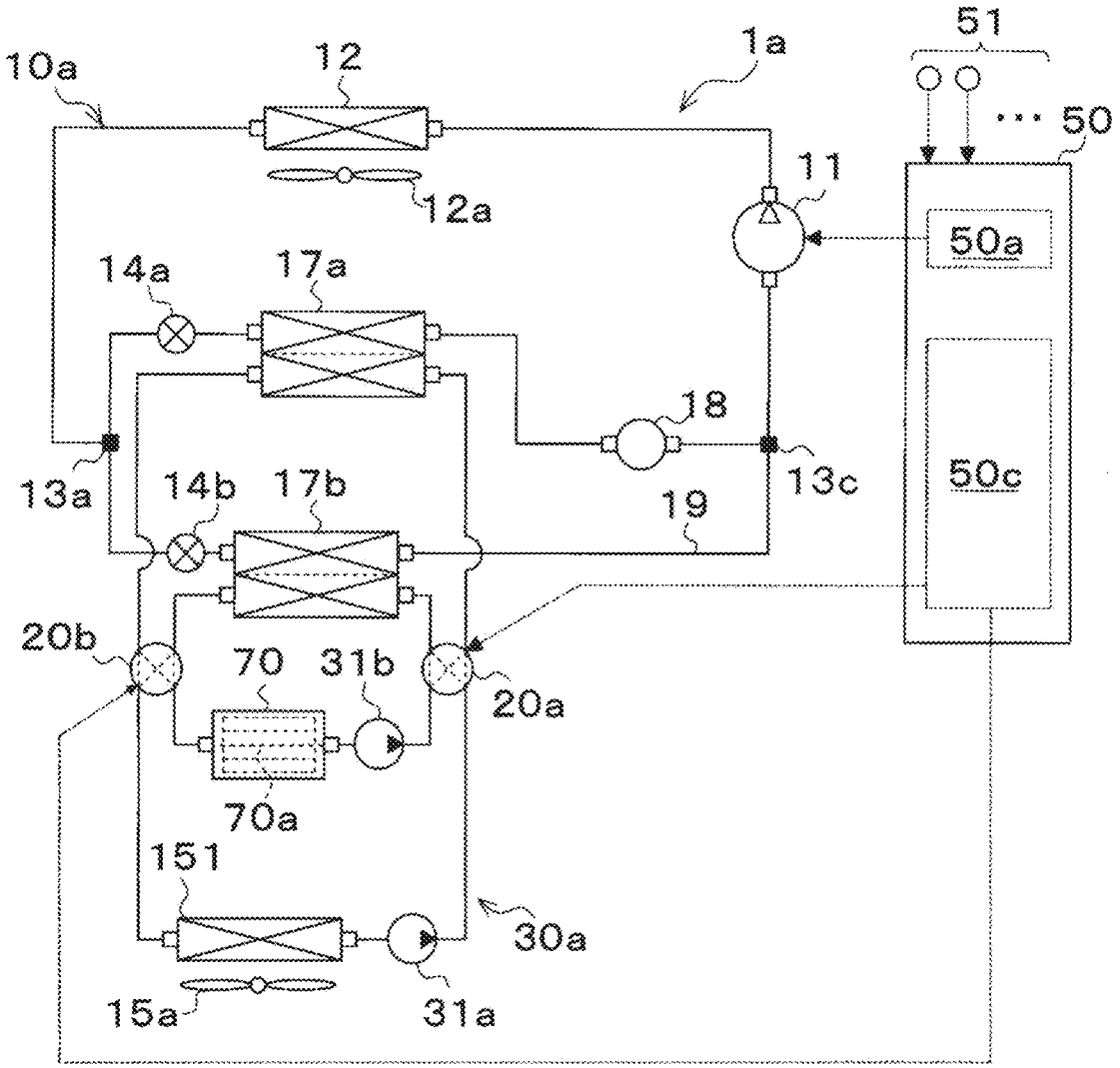
FIG. 7 is a schematic overall configuration diagram of a refrigeration cycle device according to the second embodiment.

In the present embodiment, a refrigeration cycle device 1*a* will be described. The refrigeration cycle device 1*a* of the present embodiment is applied to an air conditioner with a device cooling function similar to that of the first embodiment. As shown in the overall configuration diagram of FIG. 7, the refrigeration cycle device 1*a* includes a refrigerant circuit 10*a*, a heat medium circuit 30*a*, a control device 50, and the like.

The refrigerant circuit 10*a* includes a first chiller 17*a* instead of the air-cooling evaporator 15. In the refrigerant circuit 10*a*, the refrigerant inlet of the first chiller 17*a* is connected to the outlet of the first expansion valve 14*a*. The first chiller 17*a* is a first evaporation unit that exchanges heat between the low pressure refrigerant decompressed by the first expansion valve 14*a* and the heat medium circulating in the heat medium circuit 30*a*. The first chiller 17*a* cools the heat medium by evaporating the low pressure refrigerant to exert a heat absorbing action.

In the refrigerant circuit 10*a*, the refrigerant inlet of a second chiller 17*b* is connected to the outlet of the second expansion valve 14*b*. The second chiller 17*b* is a second evaporation unit that exchanges heat between the low pressure refrigerant decompressed by the second expansion valve 14*b* and the heat medium circulating in the heat medium circuit 30*a*. The second chiller 17*b* cools the heat medium by evaporating the low pressure refrigerant to exert a heat absorbing action.

A basic configuration of each of the first chiller 17*a* and the second chiller 17*b* is similar to that of the chiller 17 described in the first embodiment.

An inlet of the accumulator 18 is connected to a refrigerant outlet of the first chiller 17*a*. The one flow inlet port of the third three-way joint 13*c* is connected to the refrigerant outlet of the second chiller 17*b*. The other flow inlet port of the third three-way joint 13*c* is connected to the gas refrigerant outlet of the accumulator 18.

Therefore, in the refrigerant circuit 10*a*, the first three-way valve 16*a*, the second three-way valve 16*b*, the first bypass passage 19*a*, the second bypass passage 19*b*, and the like described in the first embodiment are eliminated. Further, in the refrigerant circuit 10*a*, the refrigerant passage from the refrigerant outlet of the second chiller 17*b* to the one flow inlet port of the third three-way joint 13*c* serves as a bypass passage 19 that guides the refrigerant flowing out of the second chiller 17*b* to the suction port of the compressor 11 with the refrigerant bypassing the accumulator 18.

Next, the heat medium circuit 30*a* will be described. The heat medium circuit 30*a* is a circuit that circulates a heat medium that has absorbed at least one of heat of the ventilation air and heat of the device to be cooled 70. In other words, the heat medium circuit 30*a* is a circuit that circulates a heat medium for conveying heat of the ventilation air and heat of the device to be cooled 70.

A first heat medium pump 31*a*, a second heat medium pump 31*b*, a first heat medium four-way valve 20*a*, a second heat medium four-way valve 20*b*, a cooler core 151, the cooling water passage 70*a* formed in the device to be cooled 70, the heat medium passage of the first chiller 17*a*, the heat medium passage of the second chiller 17*b*, and the like are connected to the heat medium circuit 30*a*.

The cooler core 151 is a cooling heat exchange unit that exchanges heat between the heat medium cooled by at least one of the first chiller 17*a* and the second chiller 17*b* and the ventilation air blown from the indoor blower 15*a* to cool the ventilation air.

The first heat medium pump 31*a* is a heat medium pressure feeding unit that pressure-feeds the heat medium flowing out of the cooler core 151 to one heat medium flow inlet port of the first heat medium four-way valve 20*a*. The second heat medium pump 31*b* is a heat medium pressure feeding unit that pressure-feeds the heat medium flowing out from the cooling water passage 70*a* of the device to be cooled 70 to the other heat medium flow inlet port of the first heat medium four-way valve 20*a*.

The basic configuration of each of the first heat medium pump 31*a* and the second heat medium pump 31*b* is similar to that of the heat medium pump 31 described in the first embodiment.

The first heat medium four-way valve 20*a* has two heat medium flow inlet ports and two heat medium flow outlet ports. The inlet of the heat medium passage of the first chiller 17*a* is connected to one heat medium flow outlet port of the first heat medium four-way valve 20*a*. The inlet of the heat medium passage of the second chiller 17*b* is connected to the other heat medium flow outlet port of the first heat medium four-way valve 20*a*.

The first heat medium four-way valve 20*a* can cause the heat medium flowing into the inside to flow out from at least one heat medium flow outlet port. The first heat medium four-way valve 20*a* can continuously adjust the flow rate ratio between the flow rate of the heat medium flowing out from one heat medium flow outlet port to the first chiller 17*a* and the flow rate of the heat medium flowing out from the other heat medium flow outlet port to the second chiller 17*b*.

In the first heat medium four-way valve 20*a*, the heat medium flowing out of the cooler core 151 can flow into the inside and flow out to any one of the first chiller 17*a* and the second chiller 17*b*. At the same time, in the first heat medium four-way valve 20*a*, the heat medium flowing out from the cooling water passage 70*a* of the device to be cooled 70 can flow into the inside and flow out to the other of the first chiller 17*a* and the second chiller 17*b*.

Further, in the first heat medium four-way valve 20*a*, the heat medium flowing out of the cooler core 151 and the heat medium flowing out of the cooling water passage 70*a* of the device to be cooled 70 can be mixed and flown out to at least one of the first chiller 17*a* and the second chiller 17*b*.

The operation of the first heat medium four-way valve 20*a* is controlled by a control signal output from the control device 50. Such a heat medium four-way valve can be formed by combining an electric three-way valve and an electromagnetic valve.

One heat medium flow inlet port of the second heat medium four-way valve 20*b* is connected to the outlet of the heat medium passage of the first chiller 17*a*. The other heat medium flow inlet port of the second heat medium four-way valve 20*b* is connected to the outlet of the heat medium passage of the second chiller 17*b*. The basic configuration of the second heat medium four-way valve 20*b* is similar to that of the first heat medium four-way valve 20*a*.

A heat medium inlet of the cooler core 151 is connected to one heat medium flow outlet port of the second heat medium four-way valve 20*b*. The inlet of the cooling water passage 70*a* of the device to be cooled 70 is connected to the other heat medium flow outlet port of the second heat medium four-way valve 20*b*.

The second heat medium four-way valve 20*b* can cause the heat medium flowing into the inside to flow out from at least one heat medium flow outlet port. The second heat medium four-way valve 20*b* can continuously adjust the flow rate ratio between the flow rate of the heat medium flowing out from one heat medium flow outlet port to the cooler core 151 and the flow rate of the heat medium flowing out from the other heat medium flow outlet port to the cooling water passage 70*a* of the device to be cooled 70.

In the second heat medium four-way valve 20*b*, the heat medium flowing out of the first chiller 17*a* can flow into the inside and flow out to any one of the cooler core 151 and the cooling water passage 70*a* of the device to be cooled 70. At the same time, in the second heat medium four-way valve 20*b*, the heat medium flowing out from the second chiller 17*b* can flow into the inside and flow out to the other of the cooler core 151 and the cooling water passage 70*a* of the device to be cooled 70.

Furthermore, in the second heat medium four-way valve 20*b*, the heat medium flowing out from the first chiller 17*a* and the heat medium flowing out from the second chiller 17*b* can be mixed and flow out to at least one of the cooler core 151 and the cooling water passage 70*a* of the device to be cooled 70.

Therefore, the first heat medium four-way valve 20*a* and the second heat medium four-way valve 20*b* are heat medium circuit switching units that switch the heat medium circuit 30*a*.

Next, the control device 50 of the refrigeration cycle device 1*a* will be described. In the control device 50, a configuration for controlling the operations of the first heat medium four-way valve 20*a* and the second heat medium four-way valve 20*b*, which are heat medium circuit switching units, is a heat medium circuit control unit 50*c*. Other configurations of the refrigeration cycle device 1*a* are similar to those of the refrigeration cycle device 1 described in the first embodiment.

Next, the operation of the refrigeration cycle device 1*a* of the present embodiment having the above configuration will be described. The refrigeration cycle device 1*a* switches various operation modes as in the first embodiment in order to cool the ventilation air and the device to be cooled 70. The detailed operation of each operation mode will be described below.

(a) First Cooling Mode

In the first cooling mode, the control device 50 brings the first expansion valve 14*a* into the throttling state and brings the second expansion valve 14*b* into the fully closed state.

Figure 8:
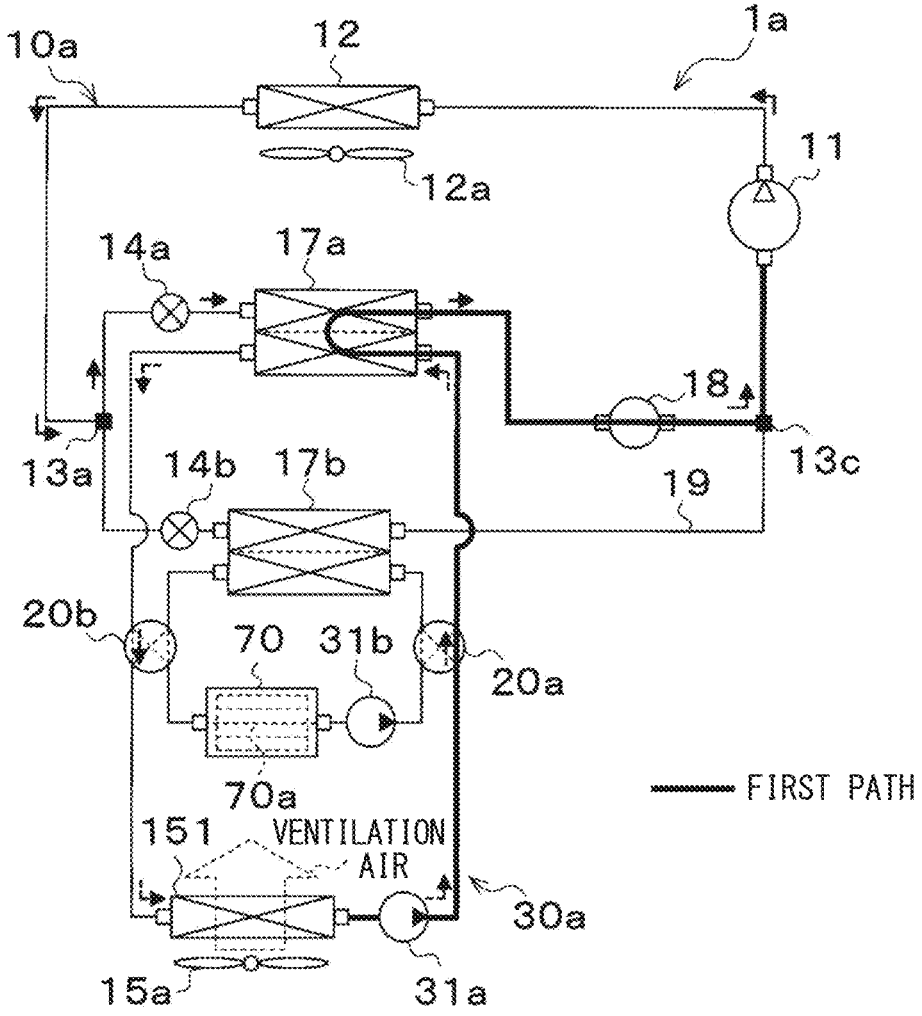
FIG. 8 is a schematic overall configuration diagram illustrating a flow and the like of a refrigerant in a first cooling mode of the refrigeration cycle device according to the second embodiment.

Therefore, as indicated by solid arrows in FIG. 8, the refrigerant circuit 10*a* in the first cooling mode is switched to a refrigerant circuit in which the refrigerant discharged from the compressor 11 circulates through the radiator 12, the first expansion valve 14*a*, the first chiller 17*a*, the accumulator 18, and the suction port of the compressor 11 in this order.

The control device 50 operates the first heat medium pump 31*a*. Further, the control device 50 controls the operation of the first heat medium four-way valve 20*a* so that the entire flow rate of the heat medium flowing in from the cooler core 151 flows out to the first chiller 17*a*. Further, the control device 50 controls the operation of the second heat medium four-way valve 20*b* so that the entire flow rate of the heat medium flowing in from the first chiller 17*a* flows out to the cooler core 151.

Therefore, as indicated by the broken arrow in FIG. 8, the heat medium circuit 30*a* in the first cooling mode is switched to the heat medium circuit in which the heat medium pressure-fed from the first heat medium pump 31*a* circulates through the first heat medium four-way valve 20*a*, the heat medium passage of the first chiller 17*a*, the second heat medium four-way valve 20*b*, the cooler core 151, and the suction port of the first heat medium pump 31*a* in this order.

The control device 50 operates the indoor blower 15*a*. The control device 50 appropriately controls the operations of the various devices to be controlled so that the temperature of the ventilation air is an appropriate temperature for air-cooling the space to be air conditioned.

Therefore, in the refrigerant circuit 10*a* in the first cooling mode, a vapor compression refrigeration cycle is configured in which the radiator 12 functions as a condenser and the first chiller 17*a* functions as an evaporator. In the first chiller 17*a*, the heat medium is cooled.

In the heat medium circuit 30*a* in the first cooling mode, the heat medium cooled by the first chiller 17*a* flows into the cooler core 151. The ventilation air is cooled in the cooler core 151.

As a result, in the refrigeration cycle device 1*a* in the first cooling mode, the ventilation air cooled by the cooler core 151 is blown out into the space to be air conditioned, thereby air-cooling the space to be air conditioned.

In FIG. 8, the first path is indicated by a thick solid line. In the refrigeration cycle device 1*a*, the accumulator 18 is disposed in the first path. A bypass passage 19 serves as a first bypass path. The first heat medium four-way valve 20*a* and the second heat medium four-way valve 20*b* serve as a first switching unit and a second switching unit. In the first cooling mode, the first heat medium four-way valve 20*a* and the second heat medium four-way valve 20*b* switch a mode to the first circulation mode.

(b) Second cooling mode

In the second cooling mode, the control device 50 brings the first expansion valve 14*a* into the throttling state and brings the second expansion valve 14*b* into the fully closed state.

Figure 9:
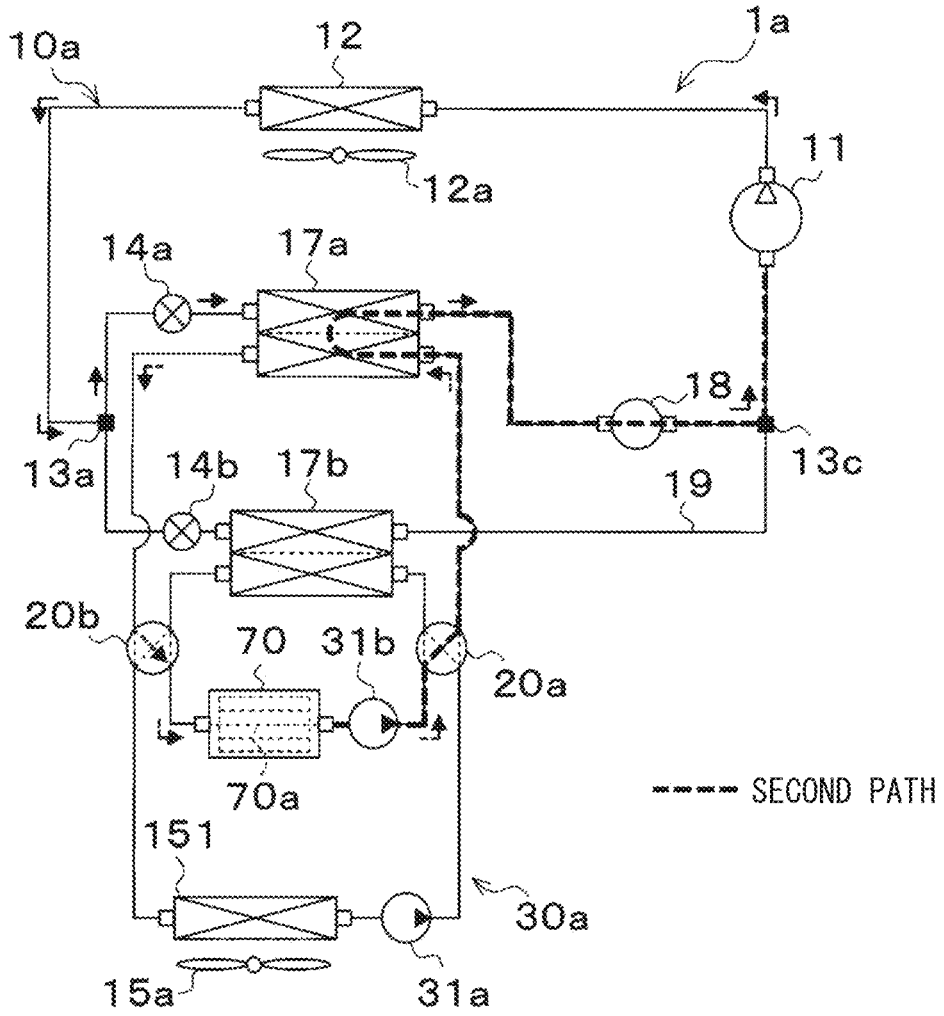
FIG. 9 is a schematic overall configuration diagram illustrating a flow and the like of a refrigerant in a second cooling mode of the refrigeration cycle device according to the second embodiment.

Therefore, as in the first cooling mode, as indicated by the solid arrow in FIG. 9, the refrigerant circuit 10*a* in the first cooling mode is switched to the refrigerant circuit in which the refrigerant discharged from the compressor 11 circulates through the radiator 12, the first expansion valve 14*a*, the first chiller 17*a*, the accumulator 18, and the suction port of the compressor 11 in this order.

The control device 50 operates the second heat medium pump 31*b*. In addition, the control device 50 controls the operation of the first heat medium four-way valve 20*a* so that the entire flow rate of the heat medium flowing in from the cooling water passage 70*a* of the device to be cooled 70 flows out to the first chiller 17*a*. In addition, the control device 50 controls the operation of the second heat medium four-way valve 20*b* so that the entire flow rate of the heat medium flowing in from the first chiller 17*a* flows out to the cooling water passage 70*a* of the device to be cooled 70.

Therefore, as indicated by the broken arrow in FIG. 9, the heat medium circuit 30*a* in the second cooling mode is switched to the heat medium circuit in which the heat medium pressure-fed from the second heat medium pump 31*b* circulates in the order of the first heat medium four-way valve 20*a*, the heat medium passage of the first chiller 17*a*, the second heat medium four-way valve 20*b*, the cooling water passage 70*a* of the device to be cooled 70, and the suction port of the second heat medium pump 31*b*.

In addition, the control device 50 appropriately controls the operations of the various devices to be controlled so that the temperature of the device to be cooled 70 is an appropriate temperature.

Therefore, in the refrigerant circuit 10*a* in the second cooling mode, a vapor compression refrigeration cycle is configured in which the radiator 12 functions as a condenser and the first chiller 17*a* functions as an evaporator. In the first chiller 17*a*, the heat medium is cooled.

In the heat medium circuit 30*a* in the second cooling mode, the heat medium cooled by the first chiller 17*a* flows into the cooling water passage 70*a* of the device to be cooled 70.

As a result, in the refrigeration cycle device 1*a* in the second cooling mode, the heat medium cooled by the first chiller 17*a* flows through the cooling water passage 70*a* of the device to be cooled 70, whereby the device to be cooled 70 is cooled.

In FIG. 9, the second path is indicated by a thick broken line. In the refrigeration cycle device 1*a*, the accumulator 18 is disposed in the second path. The bypass passage 19 also serves as a second bypass path. In the second cooling mode, the first heat medium four-way valve 20*a* and the second heat medium four-way valve 20*b* switch a mode to the second circulation mode.

(c) Composite Cooling Mode

The composite cooling mode of the refrigeration cycle device 1*a* includes (c-1) the first composite cooling mode and (c-2) the second composite cooling mode. In the composite cooling mode of the present embodiment, the operation mode is selected so that, by switching the circuit configuration of the heat medium circuit 30*a*, the enthalpy of the outlet refrigerant of the second chiller 17*b* is higher than the enthalpy of the outlet refrigerant of the first chiller 17*a*, and the outlet refrigerant of the second chiller 17*b* is a gas refrigerant having a degree of superheat.

(c-1) First composite cooling mode

In the refrigerant circuit 10*a* in the first composite cooling mode, the control device 50 brings the first expansion valve 14*a* into the throttling state and brings the second expansion valve 14*b* into the throttling state.

Figure 10:
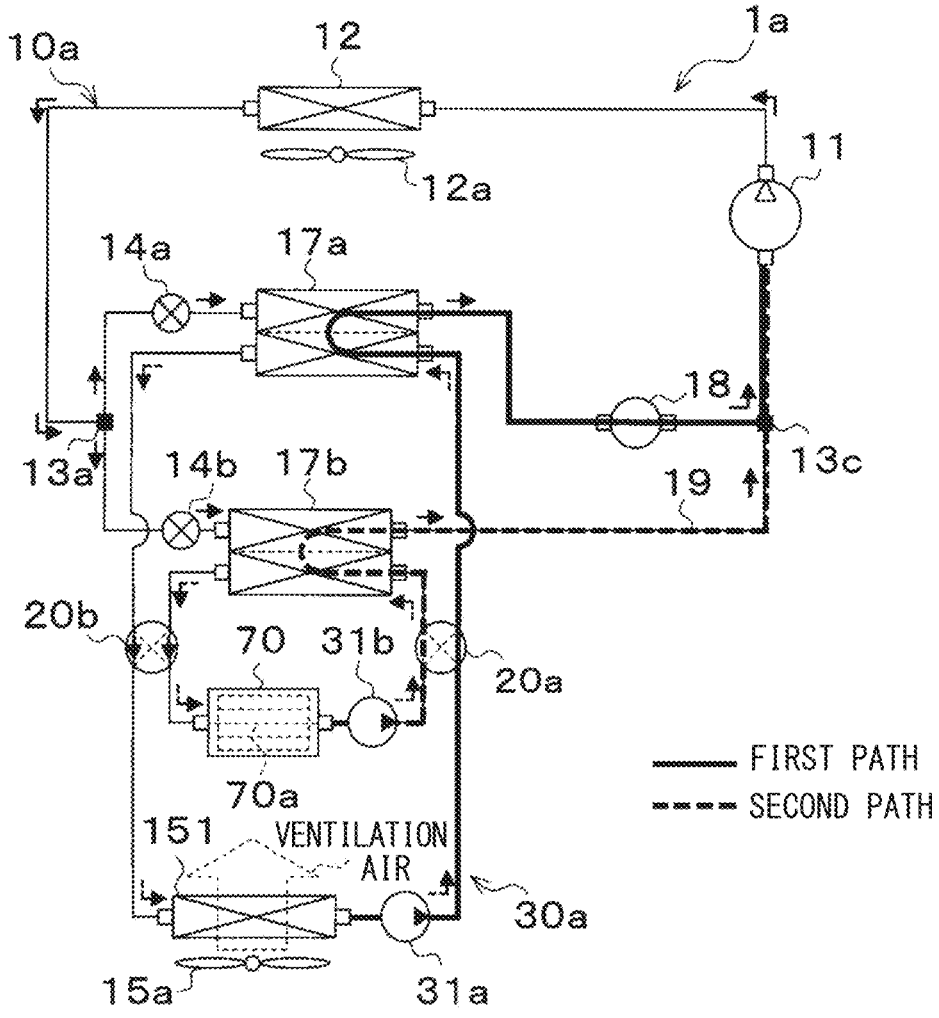
FIG. 10 is a schematic overall configuration diagram illustrating a flow and the like of a refrigerant in a first composite cooling mode of the refrigeration cycle device according to the second embodiment.

Therefore, in the refrigerant circuit 10*a* in the first composite cooling mode, as indicated by solid arrows in FIG. 10, the refrigerant discharged from the compressor 11 circulates through the radiator 12, the first expansion valve 14*a*, the first chiller 17*a*, the accumulator 18, and the suction port of the compressor 11 in this order. At the same time, the circuit is switched to a refrigerant circuit in which the refrigerant discharged from the compressor 11 circulates through the radiator 12, the second expansion valve 14*b*, the second chiller 17*b*, and the suction port of the compressor 11 in this order.

The control device 50 operates the first heat medium pump 31*a* and the second heat medium pump 31*b*.

In addition, the control device 50 controls the operation of the first heat medium four-way valve 20*a* so that the entire flow rate of the heat medium flowing in from the cooler core 151 flows out to the first chiller 17*a* and the entire flow rate of the heat medium flowing in from the cooling water passage 70*a* of the device to be cooled 70 flows out to the second chiller 17*b*.

In addition, the control device 50 controls the operation of the second heat medium four-way valve 20*b* so that the entire flow rate of the heat medium flowing in from the first chiller 17*a* flows out to the cooler core 151 and at the same time, the entire flow rate of the heat medium flowing in from the second chiller 17*b* flows out to the cooling water passage 70*a* of the device to be cooled 70.

Therefore, as indicated by the broken arrow in FIG. 10, the heat medium circuit 30*a* in the first composite cooling mode is switched to the heat medium circuit in which the heat medium pressure-fed from the first heat medium pump 31*a* circulates through the first heat medium four-way valve 20*a*, the heat medium passage of the first chiller 17*a*, the second heat medium four-way valve 20*b*, the cooler core 151, and the suction port of the first heat medium pump 31*a* in this order. At the same time, the circuit is switched to the heat medium circuit in which the heat medium pressure-fed from the second heat medium pump 31*b* circulates through the first heat medium four-way valve 20*a*, the heat medium passage of the second chiller 17*b*, the second heat medium four-way valve 20*b*, the cooling water passage 70*a* of the device to be cooled 70, and the suction port of the second heat medium pump 31*b* in this order.

The control device 50 operates the indoor blower 15*a*. The control device 50 appropriately controls the operations of the various devices to be controlled so that the temperature of the ventilation air is an appropriate temperature for air-cooling the space to be air conditioned and the temperature of the device to be cooled 70 is an appropriate temperature.

Therefore, in the refrigerant circuit 10*a* in the first composite cooling mode, a vapor compression refrigeration cycle is configured in which the radiator 12 functions as a condenser and the first chiller 17*a* and the second chiller 17*b* function as evaporators. In each of the first chiller 17*a* and the second chiller 17*b*, the heat medium is cooled.

In the heat medium circuit 30*a* in the first composite cooling mode, as indicated by the broken arrow in FIG. 10, the heat medium cooled by the first chiller 17*a* flows into the cooler core 151. The heat medium cooled by the second chiller 17*b* flows into the cooling water passage 70*a* of the device to be cooled 70.

As a result, in the refrigeration cycle device 1*a* in the first composite cooling mode, the ventilation air cooled by the cooler core 151 is blown out into the space to be air conditioned, thereby air-cooling the space to be air conditioned. The heat medium cooled by the second chiller 17*b* flows through the cooling water passage 70*a* of the device to be cooled 70, whereby the device to be cooled 70 is cooled.

In FIG. 10, the first path is indicated by a thick solid line, and the second path is indicated by a thick broken line. In the first composite cooling mode, the first heat medium four-way valve 20*a* and the second heat medium four-way valve 20*b* switch a mode to the first circulation mode and switch a mode to the second bypass circulation mode.

In the first composite cooling mode, the refrigerant flowing out of the first chiller 17*a* flows into the accumulator 18, and the refrigerant flowing out of the second chiller 17*b* bypasses the accumulator 18 and is guided to the suction port of the compressor 11.

Accordingly, in the first composite cooling mode, the enthalpy difference obtained by subtracting the enthalpy of the inlet refrigerant from the enthalpy of the outlet refrigerant of the second chiller 17*b* is increased, and the cooling capacity of the second chiller 17*b* can be increased. That is, the cooling capacity for cooling the device to be cooled 70 can be increased.

(c-2) Second Composite Cooling Mode

In the refrigerant circuit 10*a* in the second composite cooling mode, the control device 50 brings the first expansion valve 14*a* into the throttling state and brings the second expansion valve 14*b* into the throttling state.

Figure 11:
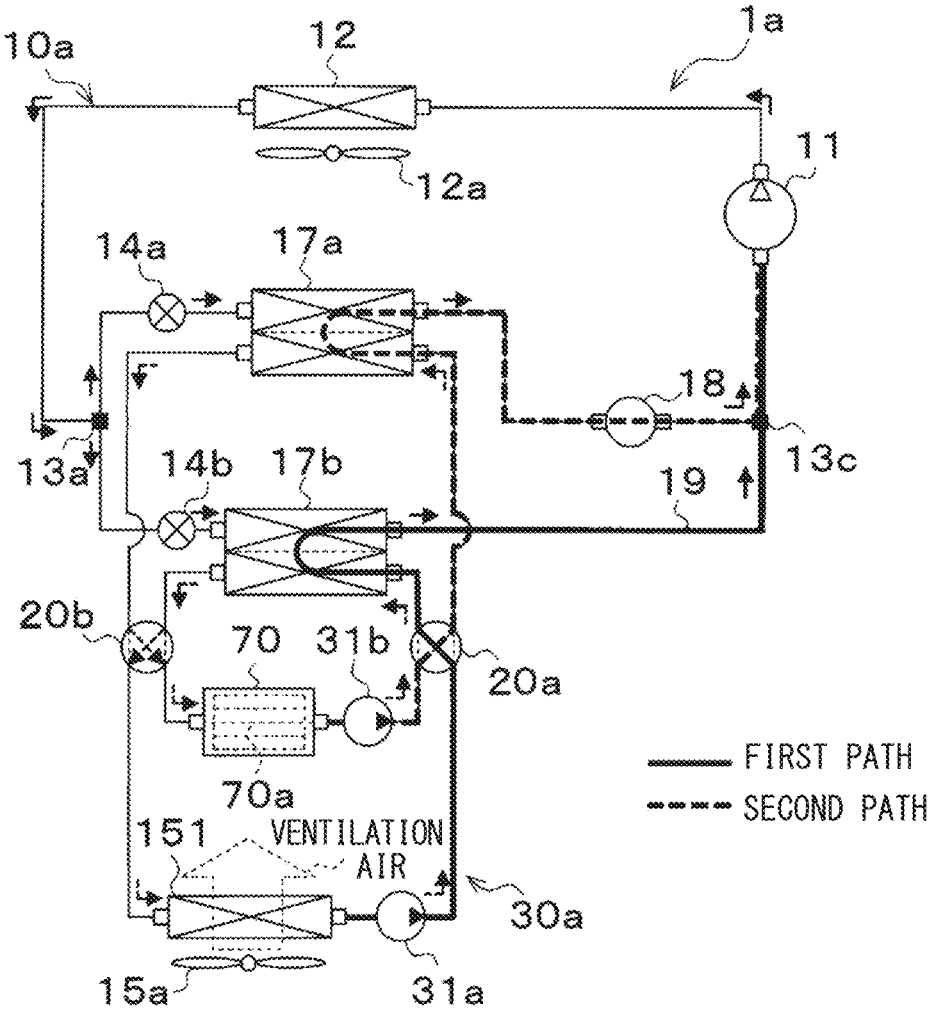
FIG. 11 is a schematic overall configuration diagram illustrating a flow and the like of a refrigerant in a second composite cooling mode of the refrigeration cycle device according to the second embodiment.

Therefore, in the refrigerant circuit 10*a* in the second composite cooling mode, as in the first composite cooling mode, as indicated by solid arrows in FIG. 11, the refrigerant discharged from the compressor 11 circulates through the radiator 12, the first expansion valve 14*a*, the first chiller 17*a*, the accumulator 18, and the suction port of the compressor 11 in this order. At the same time, the circuit is switched to a refrigerant circuit in which the refrigerant discharged from the compressor 11 circulates through the radiator 12, the second expansion valve 14*b*, the second chiller 17*b*, and the suction port of the compressor 11 in this order.

The control device 50 operates the first heat medium pump 31*a* and the second heat medium pump 31*b*.

In addition, the control device 50 controls the operation of the first heat medium four-way valve 20*a* so that the entire flow rate of the heat medium flowing in from the cooler core 151 flows out to the second chiller 17*b* and the entire flow rate of the heat medium flowing in from the cooling water passage 70*a* of the device to be cooled 70 flows out to the first chiller 17*a*.

Further, the control device 50 controls the operation of the second heat medium four-way valve 20*b* so that the entire flow rate of the heat medium flowing in from the first chiller 17*a* flows out to the cooling water passage 70*a* of the device to be cooled 70 and at the same time, the entire flow rate of the heat medium flowing in from the second chiller 17*b* flows out to the cooler core 151.

Therefore, as indicated by the broken arrow in FIG. 11, the heat medium circuit 30*a* in the second composite cooling mode is switched to the heat medium circuit in which the heat medium pressure-fed from the first heat medium pump 31*a* circulates through the first heat medium four-way valve 20*a*, the heat medium passage of the second chiller 17*b*, the second heat medium four-way valve 20*b*, the cooler core 151, and the suction port of the first heat medium pump 31*a* in this order. At the same time, the circuit is switched to the heat medium circuit in which the heat medium pressure-fed from the second heat medium pump 31*b* circulates through the first heat medium four-way valve 20*a*, the heat medium passage of the first chiller 17*a*, the second heat medium four-way valve 20*b*, the cooling water passage 70*a* of the device to be cooled 70, and the suction port of the second heat medium pump 31*b* in this order.

The control device 50 operates the indoor blower 15*a*. The control device 50 appropriately controls the operations of the various devices to be controlled so that the temperature of the ventilation air is an appropriate temperature for air-cooling the space to be air conditioned and the temperature of the device to be cooled 70 is an appropriate temperature.

Therefore, in the refrigerant circuit 10*a* in the second composite cooling mode, a vapor compression refrigeration cycle is configured in which the radiator 12 functions as a condenser and the first chiller 17*a* and the second chiller 17*b* function as evaporators. In each of the first chiller 17*a* and the second chiller 17*b*, the heat medium is cooled.

In the heat medium circuit 30*a* in the second composite cooling mode, as indicated by the broken arrow in FIG. 11, the heat medium cooled by the second chiller 17*b* flows into the cooler core 151. The heat medium cooled by the first chiller 17*a* flows into the cooling water passage 70*a* of the device to be cooled 70.

As a result, in the refrigeration cycle device 1*a* in the second composite cooling mode, the ventilation air cooled by the cooler core 151 is blown out into the space to be air conditioned, thereby air-cooling the space to be air conditioned. The heat medium cooled by the first chiller 17*a* flows through the cooling water passage 70*a* of the device to be cooled 70, whereby the device to be cooled 70 is cooled.

In FIG. 11, the first path is indicated by a thick solid line, and the second path is indicated by a thick broken line. In the second composite cooling mode, the first heat medium four-way valve 20*a* and the second heat medium four-way valve 20*b* switch a mode to the first bypass circulation mode and switch a mode to the second circulation mode.

In the second composite cooling mode, the refrigerant flowing out of the first chiller 17*a* flows into the accumulator 18, and the refrigerant flowing out of the second chiller 17*b* bypasses the accumulator 18 and is guided to the suction port of the compressor 11.

Accordingly, in the second composite cooling mode, the enthalpy difference obtained by subtracting the enthalpy of the inlet refrigerant from the enthalpy of the outlet refrigerant of the second chiller 17*b* is increased, and the cooling capacity of the second chiller 17*b* can be increased. That is, the cooling capacity for cooling the ventilation air can be increased.

As described above, the refrigeration cycle device 1 according to the present embodiment can perform comfortable air-cooling of the space to be air conditioned and appropriate cooling of the device to be cooled 70 by switching the operation mode.

The refrigeration cycle device 1*a* according to the present embodiment can also achieve effects similar to those of the refrigeration cycle device 1 described in the first embodiment. In other words, the refrigeration cycle device 1*a* according to the present embodiment also enables the evaporation unit to exhibit an appropriate cooling capacity.

More specifically, in the refrigeration cycle device 1*a* of the present embodiment, the accumulator 18 is disposed in at least one of the first path and the second path in any operation mode. Therefore, in the first chiller 17*a*, the refrigerant that has absorbed heat of at least one of the ventilation air and the device to be cooled 70 can flow into the accumulator 18.

In other words, in the refrigeration cycle device 1*a* of the present embodiment, in any operation mode, the first heat medium four-way valve 20*a* and the second heat medium four-way valve 20*b* switch the refrigerant circuit as follows. That is, the circuit is switched to a heat medium circuit that exchanges heat between at least one of the heat medium that has absorbed the heat of the ventilation air and the heat medium that has absorbed the heat of the device to be cooled 70 and the refrigerant flowing through the first chiller 17*a*.

Accordingly, the accumulator 18 can store the surplus refrigerant of the cycle in any operation mode. As a result, the refrigeration cycle device 1*a* can be operated stably, and the first chiller 17*a* and the second chiller 17*b* can surely exert the cooling capacity.

According to the refrigeration cycle device 1*a* of the present embodiment, the first heat medium four-way valve 20*a* and the second heat medium four-way valve 20*b* can switch between the first circulation mode and the first bypass circulation mode. Similarly, the first heat medium four-way valve 20*a* and the second heat medium four-way valve 20*b* can switch between the second circulation mode and the second bypass circulation mode.

That is, it is possible to switch to the circuit in which any one of the first path and the second path is a path in which energy passes through the accumulator 18, and the other is a path in which energy bypasses the accumulator 18. As a result, the cooling capacity of the second chiller 17*b* can be increased. Furthermore, the flow rate of the refrigerant flowing through the accumulator 18 can be reduced to reduce the pressure loss generated when the refrigerant flows through the accumulator 18.

That is, also in the refrigeration cycle device 1*a* of the present embodiment, the evaporation unit such as the first chiller 17*a* and the second chiller 17*b* can exhibit an appropriate cooling capacity.

As described in (a) the first cooling mode and (b) the second cooling mode, the refrigeration cycle device 1*a* according to the present embodiment can cool only one of the ventilation air and the device to be cooled 70. At this time, the first heat medium four-way valve 20*a* and the second heat medium four-way valve 20*b* switch the path of the energy flow so that the heat of one of the ventilation air and the device to be cooled 70 moves to the suction refrigerant via the accumulator 18.

In other words, in the refrigeration cycle device 1*a* of the present embodiment, the heat medium circuit is switched so that the heat medium having absorbed one of the heat of the ventilation air and the heat of the device to be cooled 70 flows into the first chiller 17*a*.

As a result, even in the operation mode of cooling only one of the ventilation air and the device to be cooled 70, the surplus refrigerant for the cycle can be stored in the accumulator 18. As a result, the refrigeration cycle device 1*a* can be stably operated, and the first chiller 17*a* can reliably exhibit the cooling capacity.

As described in (c-1) the first composite cooling mode and (c-2) the second composite cooling mode, the refrigeration cycle device 1*a* according to the present embodiment can cool both the ventilation air and the device to be cooled 70. At this time, the first heat medium four-way valve 20*a* and the second heat medium four-way valve 20*b* switch the path of the energy flow so that the heat of one of the ventilation air and the device to be cooled 70 is moved to the suction refrigerant via the accumulator 18, and the heat of the other bypasses the accumulator 18 and is moved to the suction refrigerant.

In other words, in the refrigeration cycle device 1*a* of the present embodiment, the first heat medium four-way valve 20*a* and the second heat medium four-way valve 20*b* can switch the circuit to a heat medium circuit that exchanges heat between the heat medium that has absorbed heat of the ventilation air and the refrigerant flowing through the first chiller 17*a* and, at a same time, exchanges heat between the heat medium that has absorbed heat of the device to be cooled 70 and the refrigerant flowing through the second chiller 17*b*. Further, it is possible to switch the circuit to a heat medium circuit that exchanges heat between the heat medium that has absorbed heat of the device to be cooled 70 and the refrigerant flowing through the first chiller 17*a* and, at a same time, exchanges heat between the heat medium that has absorbed heat of the ventilation air and the refrigerant flowing through the second chiller 17*b*.

Further, as described in (c-1) the first composite cooling mode and (c-2) the second composite cooling mode, in the refrigeration cycle device 1*a* according to the present embodiment, the first heat medium four-way valve 20*a* and the second heat medium four-way valve 20*b* are selected in the operation mode so that the enthalpy of the outlet refrigerant of the second chiller 17*b* is higher than the enthalpy of the outlet refrigerant of the first chiller 17*a*, and the outlet refrigerant of the second chiller 17*b* is the gas refrigerant having the degree of superheat.

As a result, the second chiller 17*b* can increase the enthalpy difference obtained by subtracting the enthalpy of the inlet refrigerant from the enthalpy of the outlet refrigerant to increase the cooling capacity. Furthermore, the flow rate of the refrigerant flowing through the accumulator 18 can be reduced, and the pressure loss generated when the refrigerant flows through the accumulator 18 can be effectively reduced.

The refrigeration cycle device 1*a* of the present embodiment may execute another operation mode in addition to the above-described operation mode.

For example, an operation mode may be executed in which the first heat medium four-way valve 20*a* and the second heat medium four-way valve 20*b* switch a circuit to a heat medium circuit in which the entire flow rate of the heat medium flowing out from the cooler core 151 and the cooling water passage 70*a* of the device to be cooled 70 flows into the first chiller 17*a* and the heat medium flowing out from the first chiller 17*a* flows into both the cooler core 151 and the cooling water passage 70*a* of the device to be cooled 70. At this time, the second expansion valve 14*b* may be fully closed.

For example, an operation mode may be executed in which the first heat medium four-way valve 20*a* and the second heat medium four-way valve 20*b* switch the circuit to a circuit configuration in which the heat medium flowing out of the cooler core 151 flows into both the first chiller 17*a* and the second chiller 17*b*, and the entire flow rate of the heat medium flowing out of the first chiller 17*a* and the second chiller 17*b* flows into the cooler core 151. At this time, the first expansion valve 14*a* may be brought into the throttling state, and the second expansion valve 14*b* may be brought into the throttling state.

For example, an operation mode may be executed in which the first heat medium four-way valve 20*a* and the second heat medium four-way valve 20*b* switch a circuit to a circuit configuration in which the heat medium flowing out from the cooling water passage 70*a* of the device to be cooled 70 flows into both the first chiller 17*a* and the second chiller 17*b*, and the entire flow rate of the heat medium flowing out from the first chiller 17*a* and the second chiller 17*b* flows into the cooling water passage 70*a* of the device to be cooled 70. At this time, the first expansion valve 14*a* may be brought into the throttling state, and the second expansion valve 14*b* may be brought into the throttling state.

Even in the above operation mode, the refrigerant flowing out of the first chiller 17*a* can flow into the accumulator 18, and the surplus refrigerant for the cycle can be stored in the accumulator 18.

Further, an operation mode can be executed in which the first heat medium four-way valve 20*a* and the second heat medium four-way valve 20*b* switch a circuit to the heat medium circuit in which the entire flow rate of the heat medium flowing out from the cooler core 151 and the cooling water passage 70*a* of the device to be cooled 70 flows into the second chiller 17*b* and the heat medium flowing out from the second chiller 17*b* flows into both the cooler core 151 and the cooling water passage 70*a* of the device to be cooled 70.

Third Embodiment

Figure 12:
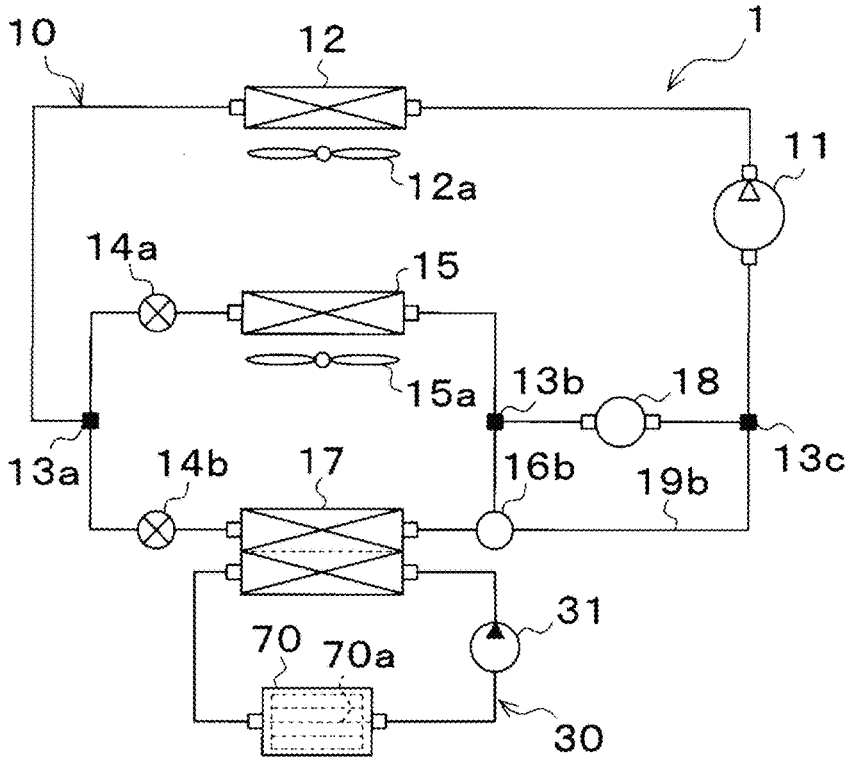
FIG. 12 is a schematic overall configuration diagram of a refrigeration cycle device according to the third embodiment.

As shown in an overall configuration diagram of FIG. 12, the refrigeration cycle device 1 according to the third embodiment is different from that according to the first embodiment in that the first three-way valve 16*a*, the first bypass passage 19*a*, and the like are not included. The refrigeration cycle device 1 according to the present embodiment can execute the operations in (a) the first cooling mode, (b) the second cooling mode, (c-1) the first composite cooling mode, and (c-3) the third composite cooling mode described in the first embodiment.

Other configurations and operations are the similarly to those of the first embodiment. Therefore, also in the refrigeration cycle device 1 of the present embodiment, at least one of the refrigerant that has absorbed heat of the ventilation air in the air-cooling evaporator 15 and the refrigerant that has absorbed heat of the refrigerant of the device to be cooled 70 in the chiller 17 can flow into the accumulator 18. The accumulator 18 can store the surplus refrigerant for the cycle.

As a result, the refrigeration cycle device 1 can be operated stably, and the air-cooling evaporator 15 and the chiller 17 can surely exert the cooling capacity. Also in the first composite cooling mode of the present embodiment, the cooling capacity of the chiller 17 can be increased as in the first embodiment. Furthermore, it is also possible to reduce a pressure loss generated when the refrigerant flows through the accumulator 18.

Fourth Embodiment

Figure 13:
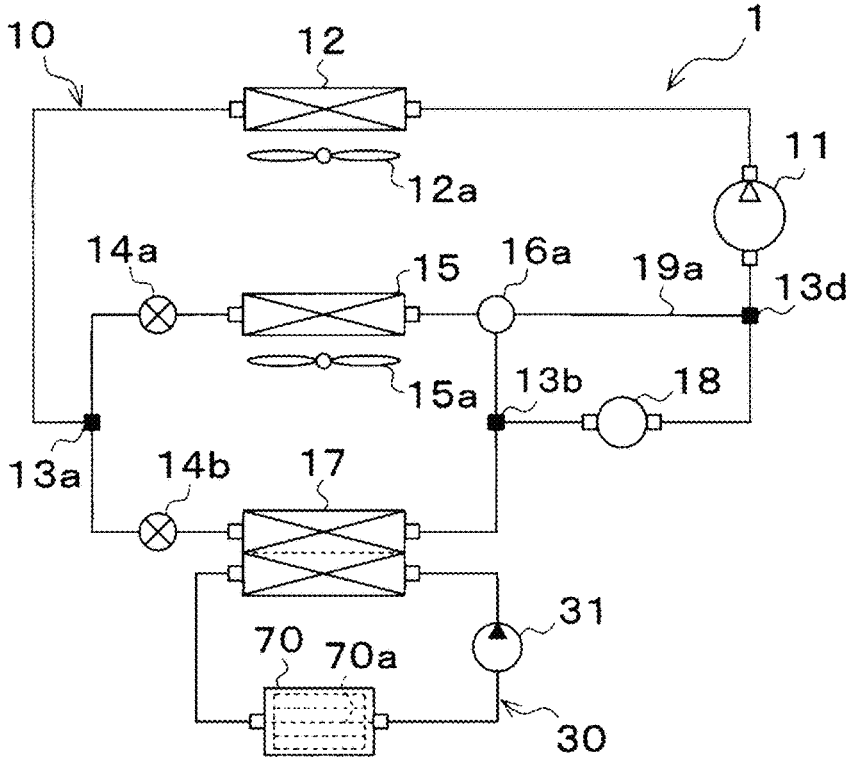
FIG. 13 is a schematic overall configuration diagram of a refrigeration cycle device according to the fourth embodiment.

As shown in an overall configuration diagram of FIG. 13, the refrigeration cycle device 1 according to the fourth embodiment is different from that according to the first embodiment in that the second three-way valve 16*b*, the second bypass passage 19*b*, and the like are not included. The refrigeration cycle device 1 according to the present embodiment can execute the operations in (a) the first cooling mode, (b) the second cooling mode, (c-2) the second composite cooling mode, and (c-3) the third composite cooling mode described in the first embodiment.

Other configurations and operations are the similarly to those of the first embodiment. Therefore, also in the refrigeration cycle device 1 of the present embodiment, at least one of the refrigerant that has absorbed heat of the ventilation air in the air-cooling evaporator 15 and the refrigerant that has absorbed heat of the refrigerant of the device to be cooled 70 in the chiller 17 can flow into the accumulator 18. The accumulator 18 can store the surplus refrigerant for the cycle.

As a result, the refrigeration cycle device 1 can be operated stably, and the air-cooling evaporator 15 and the chiller 17 can surely exert the cooling capacity. Also in the second composite cooling mode of the present embodiment, the cooling capacity of the air-cooling evaporator 15 can be increased as in the first embodiment. Furthermore, it is also possible to reduce a pressure loss generated when the refrigerant flows through the accumulator 18.

Fifth Embodiment

Figure 14:
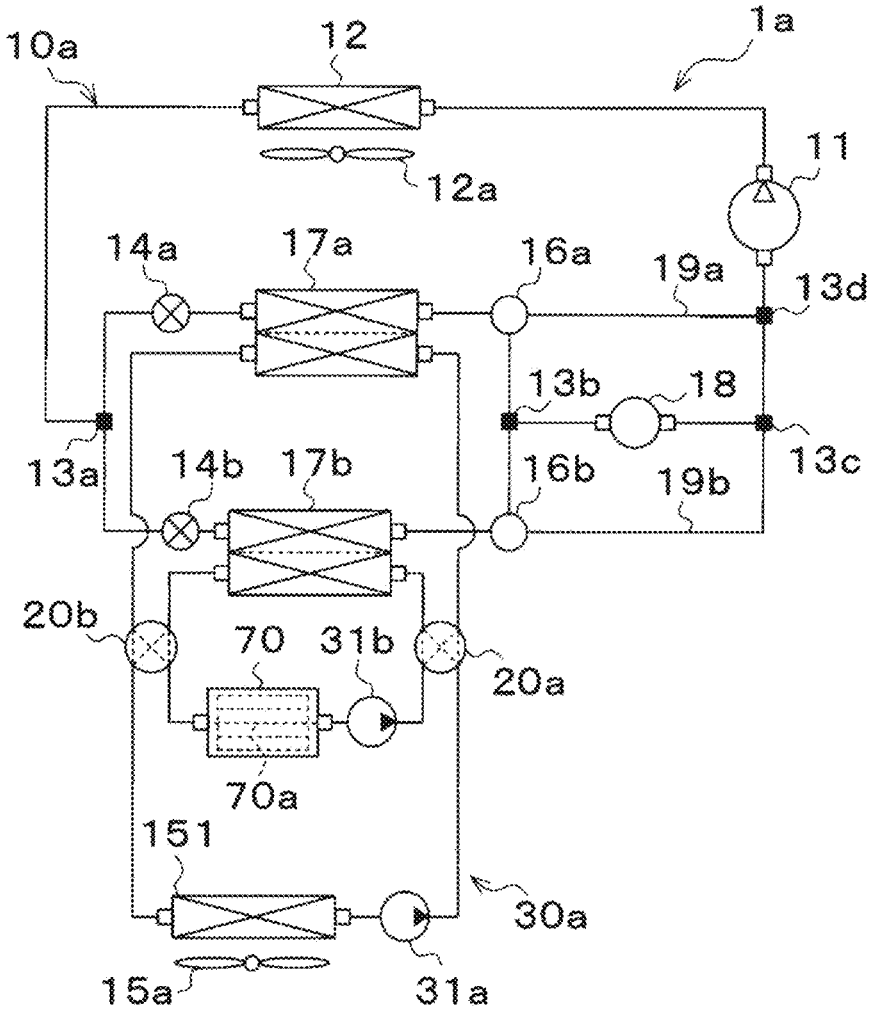
FIG. 14 is a schematic overall configuration diagram of a refrigeration cycle device according to the fifth embodiment.

As shown in the overall configuration diagram of FIG. 14, the refrigeration cycle device 1*a* according to the fifth embodiment is different from the refrigeration cycle device 1*a* according to the second embodiment in that the first three-way valve 16*a* and the second three-way valve 16*b*, which are refrigerant circuit switching units, are added. In the refrigeration cycle device 1*a* of the present embodiment, first bypass passage 19*a* and second bypass passage 19*b* are provided as bypass passages.

As described in the second embodiment, the refrigeration cycle device 1*a* according to the present embodiment can execute (a) the first cooling mode, (b) the second cooling mode, (c-1) the first composite cooling mode, and (c-2) the second composite cooling mode with the first chiller 17*a* as the first evaporation unit and the second chiller 17*b* as the second evaporation unit. Therefore, the same effects as those of the refrigeration cycle device 1*a* of the second embodiment can be obtained.

Further, an operation mode corresponding to (a) the first cooling mode, (b) the second cooling mode, (c-1) the first composite cooling mode, and (c-2) the second composite cooling mode can be executed with the second chiller 17*b* as the first evaporation unit and the first chiller 17*a* as the second evaporation unit.

According to this, the degree of freedom in selecting the operation mode can be expanded as compared with that in the second embodiment. That is, when the heat exchange performance of the first chiller 17*a* and the heat exchange performance of the second chiller 17*b* are different from each other, an appropriate evaporation unit can be selected and used. The refrigerant flowing out of the selected appropriate evaporation unit can flow into the accumulator 18.

Sixth Embodiment

Figure 15:
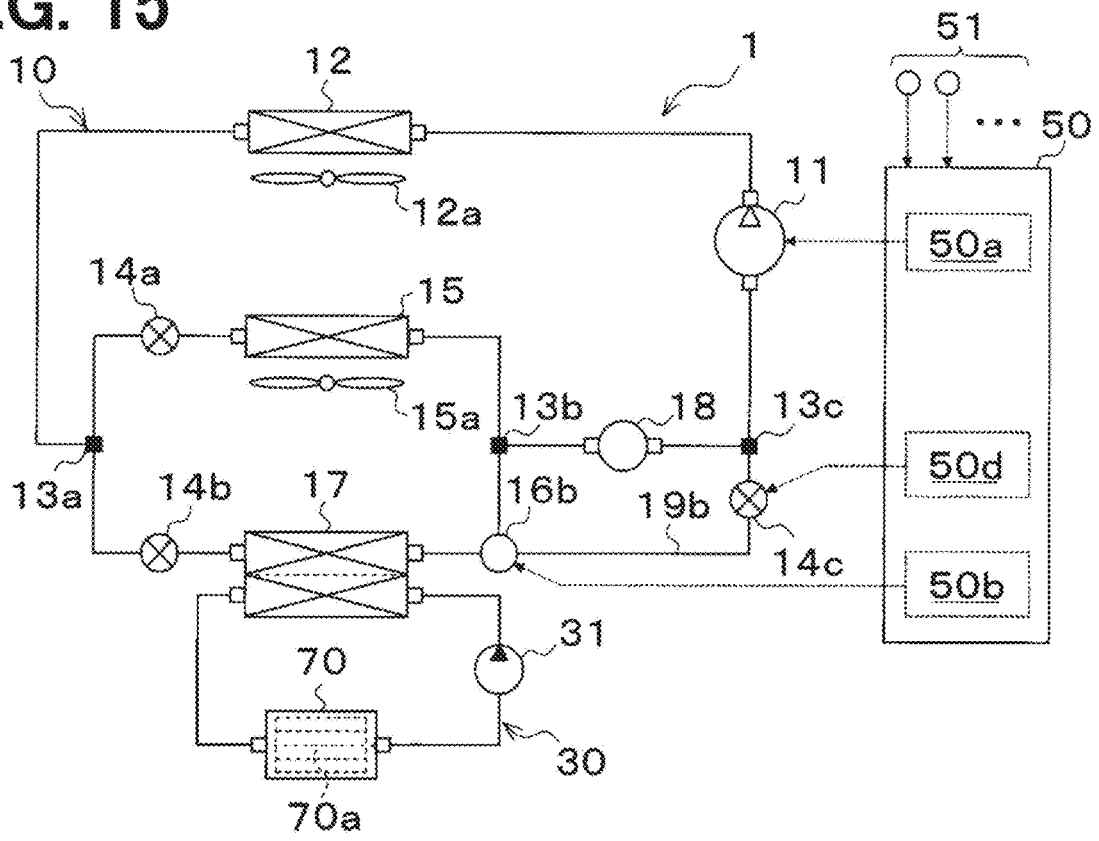
FIG. 15 is a schematic overall configuration diagram of a refrigeration cycle device according to the sixth embodiment.

In the present embodiment, as shown in an overall configuration diagram of FIG. 15, an example in which a bypass side decompression valve 14*c* is added to the refrigeration cycle device 1 described in the third embodiment will be described. The bypass side decompression valve 14*c* is disposed in the second bypass passage 19*b*. Therefore, the bypass side decompression valve 14*c* is a bypass side decompression unit that decompresses the refrigerant flowing through the bypass passage as the bypass path.

The basic configuration of the bypass side decompression valve 14*c* is similar to that of the first expansion valve 14*a* and the like. Further, the bypass side decompression valve 14*c* has a full-open function that functions as a simple refrigerant passage without exerting a refrigerant pressure reducing action and a flow rate adjusting action by setting the throttle opening to a full-open state.

Further, in the control device 50 of the present embodiment, the configuration for controlling the operation of the bypass side decompression valve 14*c* which is the bypass side decompression unit is a bypass side decompression control unit 50*d*. Other configurations of the refrigeration cycle device 1 are similar to those of the third embodiment.

Next, the operation of the refrigeration cycle device 1 having the above configuration according to the present embodiment will be described. The refrigeration cycle device 1 of the present embodiment can execute the operation in (a) the first cooling mode, (b) the second cooling mode, (c-1) the first composite cooling mode, and (c-3) the third composite cooling mode exactly as in the third embodiment by fully opening the bypass side decompression valve 14*c*. Therefore, the same effects as those of the third embodiment can be obtained.

In the first composite cooling mode, as described in the third embodiment and the like, the degree of superheat of the outlet refrigerant of the chiller 17 can be increased to increase the cooling capacity of the chiller 17. On the other hand, when the degree of superheat of the outlet refrigerant of the chiller 17 is unnecessarily increased, the discharge refrigerant temperature Td is unnecessarily increased, which may adversely affect the durable life of the compressor 11.

Therefore, in the first composite cooling mode of the present embodiment, the control device 50 controls the operations of the second expansion valve 14*b* and the bypass side decompression valve 14*c* so that the discharge refrigerant temperature Td is equal to or lower than a predetermined reference discharge refrigerant temperature KTd. In the present embodiment, the maximum allowable temperature determined from the durability of the compressor 11 is used as the reference discharge refrigerant temperature KTd.

Figure 16:
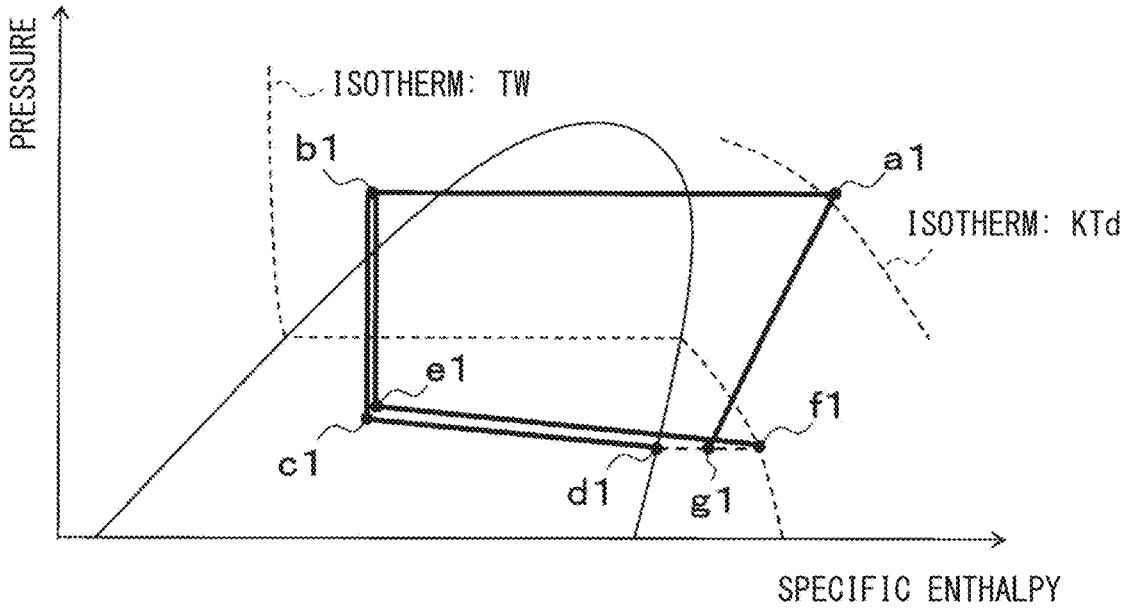
FIG. 16 is a Mollier diagram illustrating a change in a state of a refrigerant in a comparative operation mode of the refrigeration cycle device according to the sixth embodiment.

The first composite cooling mode of the present embodiment will be described in detail with reference to Mollier diagrams of FIGS. 16 and 17. First, the Mollier diagram of FIG. 16 illustrates a change in the state of the refrigerant in the comparative operation mode. The comparative operation mode is the first composite cooling mode executed under an operation condition in which the bypass side decompression valve 14*c* is fully opened and the discharge refrigerant temperature Td exceeds the reference discharge refrigerant temperature KTd.

In the comparative operation mode, the discharge refrigerant discharged from compressor 11 (point a1 in FIG. 16) flows into the radiator 12. The discharge refrigerant having flowed into the radiator 12 exchanges heat with outside air to dissipate heat (from point a1 to point b1 in FIG. 16). The refrigerant flowing out of the radiator 12 flows into the first three-way joint 13*a* and branches.

One refrigerant branched at the first three-way joint 13*a* flows into the first expansion valve 14*a* and is decompressed (from point b1 to point c1 in FIG. 16). The refrigerant decompressed by the first expansion valve 14*a* flows into the air-cooling evaporator 15. The refrigerant having flowed into the air-cooling evaporator 15 absorbs heat from the ventilation air and evaporates (from point c1 to point d1 in FIG. 16).

The refrigerant flowing out of the air-cooling evaporator 15 flows into the accumulator 18. Therefore, the outlet refrigerant of the air-cooling evaporator 15 is a saturated gas refrigerant.

The other refrigerant branched at the first three-way joint 13*a* flows into the second expansion valve 14*b* and is decompressed (from point b1 to point e1 in FIG. 16). The refrigerant decompressed by the second expansion valve 14*b* flows into the chiller 17. The refrigerant flowing into the chiller 17 absorbs heat from the heat medium and evaporates (from point e1 to point f1 in FIG. 16).

In the chiller 17, the enthalpy is increased until the refrigerant has a temperature equivalent to the heat medium temperature TW. Therefore, the outlet refrigerant of the chiller 17 is a gas refrigerant having a degree of superheat. The refrigerant flowing out of the chiller 17 flows into the bypass side decompression valve 14*c* that is fully opened.

The flow of the refrigerant flowing out of the accumulator 18 and the flow of the refrigerant flowing out of the bypass side decompression valve 14*c* are merged at the third three-way joint 13*c* (from point d1 to point g1, from point f1 to point g1 in FIG. 16). The refrigerant flowing out of the third three-way joint 13*c* (point g1 in FIG. 16) is drawn into the compressor 11 and compressed again.

In the comparative operation mode, the degree of superheat of the outlet refrigerant of the chiller 17 increases as the temperature of the heat medium that exchanges heat with the refrigerant by the chiller 17 increases. Therefore, the degree of superheat of the gas refrigerant (point g1 in FIG. 16) flowing out of the third three-way joint 13*c* is unnecessarily high, and as shown in FIG. 16, the discharge refrigerant temperature Td exceeds the reference discharge refrigerant temperature KTd. As a result, there is a possibility that protection of the compressor 11 cannot be achieved.

On the other hand, in the first composite cooling mode of the present embodiment, the control device 50 controls the operations of the second expansion valve 14*b* and the bypass side decompression valve 14*c* so that the discharge refrigerant temperature Td is equal to or lower than the reference discharge refrigerant temperature KTd. Therefore, the state of the refrigerant changes as illustrated in a Mollier diagram of FIG. 17. In FIG. 17, the state of the refrigerant at the portion equivalent to that of the Mollier diagram of FIG. 16 in terms of the cycle configuration is indicated by the reference numeral (alphabet) similarly to that in FIG. 16, and the subscript (numeral) is changed.

More specifically, in the first composite cooling mode of the present embodiment, the control device 50 increases the throttle opening of the second expansion valve 14*b* and decreases the throttle opening of the bypass side decompression valve 14*c* as compared with that in the comparative operation mode. Therefore, in the first composite cooling mode, the pressure of the refrigerant decompressed by the second expansion valve 14*b* (to point e2 in FIG. 17) is higher than that in the comparative operation mode.

The refrigerant decompressed by the second expansion valve 14*b* flows into the chiller 17. The refrigerant flowing into the chiller 17 absorbs heat from the heat medium and evaporates (from point e2 to point f21 in FIG. 17).

In the chiller 17, the enthalpy is increased until the refrigerant has a temperature equivalent to the heat medium temperature TW. Therefore, the outlet refrigerant of the chiller 17 is a gas refrigerant having a degree of superheat. In the first composite cooling mode, since the pressure of the outlet refrigerant of the chiller 17 is higher than that in the comparative operation mode, the degree of superheat of the outlet refrigerant of the chiller 17 is lower than that in the comparative operation mode.

Figure 17:
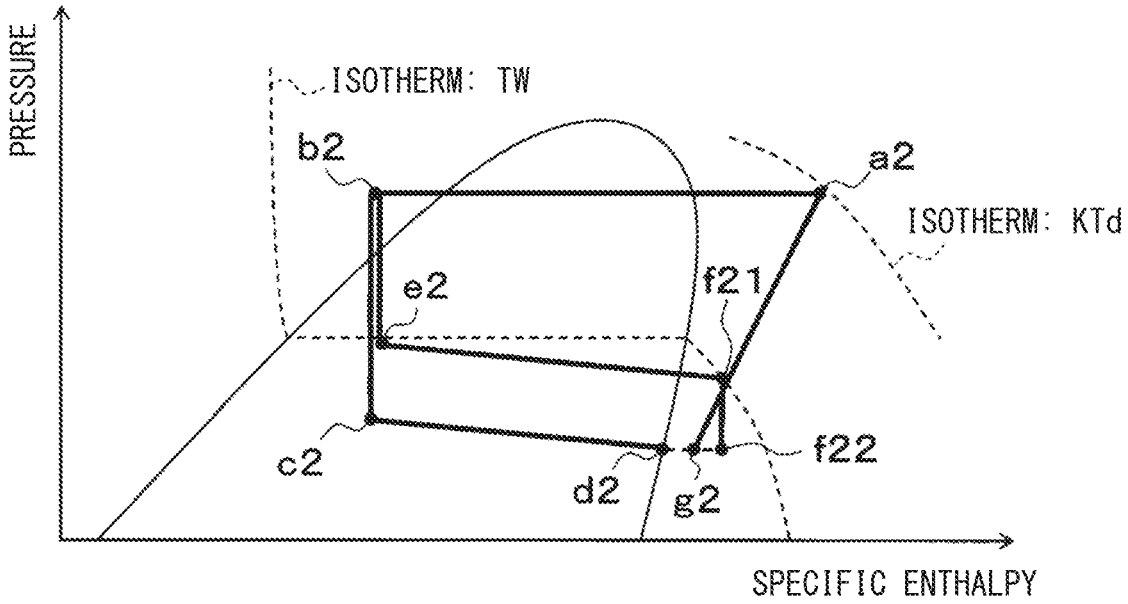
FIG. 17 is a Mollier diagram illustrating a change in a state of a refrigerant in a first composite cooling mode of the refrigeration cycle device according to the sixth embodiment.

The refrigerant flowing out of the chiller 17 flows into the bypass side decompression valve 14*c* and is decompressed (from point f21 to point f22 in FIG. 17).

The flow of the refrigerant flowing out of the accumulator 18 and the flow of the refrigerant flowing out of the bypass side decompression valve 14*c* are merged at the third three-wayjoint 13*c* (from point d2 to point g2, from point f22 to point g2 in FIG. 17). The refrigerant flowing out of the third three-way joint 13*c* (point g2 in FIG. 17) is drawn into the compressor 11 and compressed again.

In the first composite cooling mode, since the degree of superheat of the outlet refrigerant of the chiller 17 is lower than that in the comparative operation mode, the degree of superheat of the refrigerant flowing out of the third three-way joint 13*c* (point g2 in FIG. 17) is also lower than that in the comparative operation mode. As a result, the discharge refrigerant temperature Td (the temperature at point a2 in FIG. 17) can be made equal to or lower than the reference discharge refrigerant temperature KTd. As a result, the compressor 11 can be protected.

Of course, when the temperature of the heat medium that exchanges heat with the refrigerant by the chiller 17 is relatively low and the discharge refrigerant temperature Td does not exceed the reference discharge refrigerant temperature KTd, the bypass side decompression valve 14*c* may be fully opened to execute the first composite cooling mode.

The present disclosure is not limited to the above-described embodiments, and can be variously modified as follows without departing from the gist of the present disclosure.

The refrigeration cycle devices 1 and 1*a* described in the above embodiment may be applied to a vehicle air conditioner. In this case, the first object to be cooled may be ventilation air blown into the vehicle interior. The second object to be cooled may be a battery or other in-vehicle devices.

The configuration of the refrigeration cycle device according to the present disclosure is not limited to the configuration disclosed in the above embodiment.

In the first embodiment described above, the example is described in which the chiller 17 that exchanges heat between the refrigerant and the heat medium is used as the second evaporation unit, but the present invention is not limited thereto. For example, a cooling evaporator that exchanges heat between the refrigerant and the cooling ventilation air blown toward the second object to be cooled may be employed as the second evaporation unit. When the chiller 17 is employed as the second evaporation unit, a cooling heat exchange unit (that is, the cooler core) that exchanges heat between the heat medium cooled by the chiller 17 and the ventilation air blown toward the second object to be cooled may be employed.

The refrigeration cycle device may include a receiver in addition to the accumulator 18. The receiver is a high-pressure gas-liquid separation unit that separates the refrigerant flowing out of the radiator 12 into gas and liquid, and stores part of the separated refrigerant as a surplus refrigerant for the cycle. In addition to the operation mode described in the above embodiment, there may be an operation mode in which the circuit is switched to the refrigerant circuit that stores the surplus refrigerant in the receiver instead of the accumulator 18.

In the sixth embodiment described above, the example is described in which the bypass side decompression valve 14*c* that is a variable throttle mechanism is used as the bypass side decompression unit, but the present invention is not limited thereto. The bypass side decompression unit may be a fixed throttle. Specifically, as the bypass side decompression unit, an orifice, a capillary tube, a refrigerant pipe having a diameter smaller than that of other refrigerant pipes, or the like may be employed.

Furthermore, the control sensor group connected to the input of the control device 50 is not limited to the detection unit disclosed in the above-described embodiment. Various detection units may be added as necessary.

In the above embodiment, the example is described in which R1234yf is used as the refrigerant of the refrigerant circuit 10, 10*a* having the vapor compression refrigeration cycle, but the present invention is not limited thereto. For example, R134a, R600*a*, R410A, R404A, R32, R407C, or the like may be used. Alternatively, a mixed refrigerant obtained by mixing a plurality of kinds of these refrigerants or the like may be used. Furthermore, carbon dioxide may be employed as the refrigerant to form a supercritical refrigeration cycle in which the high-pressure side refrigerant pressure is equal to or higher than the critical pressure of the refrigerant.

Further, the example is described in which the ethylene glycol aqueous solution is used as the heat medium and the high-temperature side heat medium in the above-described embodiment, but the present invention is not limited thereto. As the high-temperature side heat medium and the heat medium, for example, a solution containing dimethylpolysiloxane, nanofluid or the like, an antifreeze liquid, an aqueous liquid refrigerant containing alcohol or the like, a liquid medium containing oil or the like may be used.

The control mode of the refrigeration cycle device according to the present disclosure is not limited to the control mode disclosed in the above embodiment.

In (c-1) the first composite cooling mode and (c-2) the second composite cooling mode according to the embodiment described above, the example is described in which the refrigerant that is the gas refrigerant having the higher enthalpy and the degree of superheat, of the outlet refrigerant of the first evaporation unit and the outlet refrigerant of the second evaporation unit, bypasses the accumulator 18, and is guided to the suction port of the compressor 11, but the present invention is not limited thereto.

For example, in (c-1) the first composite cooling mode and (c-2) the second composite cooling mode of the first embodiment, the intake air temperature of the ventilation air that exchanges heat with the refrigerant by the air-cooling evaporator 15 may be compared with the heat medium temperature TW, and the refrigerant flowing out of the evaporation unit into which the one having higher temperature flows may bypass the accumulator 18 and be guided to the suction port of the compressor 11.

In (c-1) the first composite cooling mode and (c-2) the second composite cooling mode of the second embodiment, a first heat medium temperature TW1 and a second heat medium temperature TW2 may be compared, and the refrigerant flowing out of the evaporation unit into which the one having higher temperature flows may bypass the accumulator 18 and be guided to the suction port of the compressor 11. The first heat medium temperature TW1 is the temperature of the heat medium flowing into the first chiller 17*a*. The second heat medium temperature TW2 is the temperature of the heat medium flowing into the second chiller 17*b*.

That is, the refrigerant flowing out of the evaporation unit where the degree of superheat of the outlet-side refrigerant is likely to be higher may bypass the accumulator 18, and be guided to the suction port of the compressor 11.

For example, of the first evaporation unit and the second evaporation unit, the refrigerant flowing out of an evaporation unit whose flow rate of the refrigerant flowing inside is higher may bypass the accumulator 18, and be guided to the suction port of the compressor 11. According to this, it is possible to effectively reduce the pressure loss generated when the refrigerant flows through the accumulator 18. As a result, the pressure of the suction refrigerant can be increased, and the discharge flow rate of the compressor 11 can be increased.

In the sixth embodiment described above, the example is described in which the operation of the bypass side decompression valve 14*c* is controlled so that the discharge refrigerant temperature Td is equal to or lower than the reference discharge refrigerant temperature KTd, but the present invention is not limited thereto. For example, the operation of the bypass side decompression valve 14*c* may be controlled so that a degree of superheat SH of the suction refrigerant is equal to or less than a predetermined reference degree of superheat KSH.

The means disclosed in each of the above embodiments may be appropriately combined within a feasible range.

For example, the bypass side decompression valve 14*c* described in the sixth embodiment may be applied to other embodiments.

When the bypass side decompression valve 14*c* is applied to the refrigeration cycle device 1 described in the first embodiment, the bypass side decompression valve 14*c* is disposed in the first bypass passage 19*a*, and the control similarly to that in the first composite cooling mode of the sixth embodiment may be performed in the second composite cooling mode. Further, the bypass side decompression valve 14*c* may be disposed in the second bypass passage 19*b* to perform the control similarly to that in the first composite cooling mode of the sixth embodiment in the first composite cooling mode.

When the bypass side decompression valve 14*c* is applied to the refrigeration cycle device 1*a* described in the second embodiment, the bypass side decompression valve 14*c* may be disposed in the bypass passage 19 to perform the control similarly to that in the first composite cooling mode of the sixth embodiment, in the first composite cooling mode and the second composite mode.

Although the present disclosure is described in accordance with examples, it is understood that the present disclosure is not limited to the examples and structures. The present disclosure also includes various modification examples and modifications within an equivalent range. In addition, various combinations and modes, and other combinations and modes including only one element, more elements, or less elements therein are also within the scope and idea of the present disclosure.

What is claimed is:

1. A refrigeration cycle device comprising:

a first evaporator and a second evaporator configured to evaporate a refrigerant circulating in a refrigerant circuit;

an accumulator configured to separate the refrigerant flowing out of at least one of the first evaporator and the second evaporator into gas and liquid, and to store a surplus refrigerant; and a compressor configured to draw and compress a gas refrigerant separated in the accumulator;

wherein:

the first evaporation unit evaporator and the second evaporator are connected in parallel to a flow of the refrigerant, when a path of an energy flow in which heat of a first object to be cooled moves to a suction refrigerant drawn into the compressor via at least one of the first evaporator and the second evaporator is defined as a first path, and a path of an energy flow in which heat of a second object to be cooled moves to the suction refrigerant via at least one of the first evaporator and the second evaporator is defined as a second path, the accumulator is disposed in at least one of the first path and the second path, when the accumulator is disposed in the first path, the refrigerant circuit includes:

a first bypass path through which heat of the first object to be cooled moves while bypassing the accumulator, and a first switching unit capable of switching between a first circulation mode in which heat of the first object to be cooled is moved via the accumulator, and a first bypass circulation mode in which heat of the first object to be cooled is moved via the first bypass path, when the accumulator is disposed in the second path, the refrigerant circuit includes:

a second bypass path through which heat of the second object to be cooled moves while bypassing the accumulator, and a second switching unit capable of switching between a second circulation mode in which heat of the second object to be cooled is moved via the accumulator, and a second bypass circulation mode in which heat of the second object to be cooled is moved via the second bypass path, and when any one object of the first object to be cooled or the second object to be cooled is cooled, the first switching unit and the second switching unit are configured to switch a path in which heat of the any one object moves via the accumulator.

2. The refrigeration cycle device according to claim 1, wherein, when both the first object to be cooled and the second object to be cooled are cooled, the first switching unit and the second switching unit are configured to switch a path in which at least a part of heat of one object of the first object to be cooled or the second object to be cooled moves via the accumulator, and at least part of heat of the other object of the first object to be cooled or the second object to be cooled moves while bypassing the accumulator.

3. The refrigeration cycle device according to claim 2, wherein, the first switching unit and the second switching unit are configured to switch the path of the energy flow, in which a gas refrigerant having a higher enthalpy and a higher degree of superheat, of the refrigerant at an outlet side of the first evaporator and the refrigerant at an outlet side of the second evaporator, is guided to a suction port of the compressor while bypassing the accumulator.

4. The refrigeration cycle device according to claim 2, wherein, the first switching unit and the second switching unit are configured to switch the path of the energy flow, in which refrigerant flowing out of one of the first evaporator or the second evaporator, having a larger flow rate of the refrigerant flowing therein, is guided to a suction port of the compressor while bypassing the accumulator.

5. The refrigeration cycle device according to claim 1, wherein the first bypass path and the second bypass path are paths through which the refrigerant flows, and wherein a bypass side decompression valve that decompresses the refrigerant is disposed in at least one of the first bypass path and the second bypass path.

6. The refrigeration cycle device according to claim 5, further comprising:

a bypass side decompression control unit configured to control an operation of the bypass side decompression valve, wherein the bypass side decompression control unit controls operation of the bypass side decompression valve such that a discharge refrigerant temperature that is a temperature of a discharge refrigerant discharged from the compressor is lower than or equal to a predetermined reference discharge refrigerant temperature.

7. The refrigeration cycle device according to claim 1, wherein the first switching unit and the second switching unit are refrigerant circuit switching units that switch the first path and the second path by switching the refrigerant circuit.

8. The refrigeration cycle device according to claim 1, further comprising:

a heat medium circuit that circulates a heat medium that conveys heat of the first object to be cooled and heat of the second object to be cooled, wherein the first switching unit and the second switching unit are heat-medium circuit switching units that switch the first path and the second path by switching the heat medium circuit.

9. A refrigeration cycle device comprising:

a first evaporator and a second evaporator configured to evaporate a refrigerant circulating in a refrigerant circuit;

an accumulator configured to separate the refrigerant flowing out of at least one of the first evaporator and the second evaporator into gas and liquid to store a surplus refrigerant; and a compressor configured to draw and compress a gas refrigerant separated in the accumulator;

wherein:

the first evaporator and the second evaporator are connected in parallel to a flow of the refrigerant, the refrigeration cycle device includes a bypass passage configured to guide at least one of the refrigerant flowing out of the first evaporator and the refrigerant flowing out of the second evaporator to a suction port of the compressor while bypassing the accumulator, and a refrigerant circuit switching unit configured to switch a refrigerant cycle in which at least one of the refrigerant flowing out of the first evaporator and the refrigerant flowing out of the second evaporator flows into the accumulator, and the refrigerant circuit switching unit is capable of switching between: a first refrigerant cycle in which the refrigerant flowing out of the first evaporator flows into the accumulator, and the refrigerant flowing out of the second evaporator flows into the bypass passage; and a second refrigerant cycle in which the refrigerant flowing out of the second evaporator flows into the accumulator, and the refrigerant flowing out of the first evaporator flows into the bypass passage.

10. The refrigeration cycle device according to claim 9, further comprising:

a bypass side decompression valve configured to decompress the refrigerant flowing through the bypass passage.

11. A refrigeration cycle device comprising:

a first evaporator and a second evaporator configured to evaporate a refrigerant circulating in a refrigerant circuit, the first evaporator and the second evaporator being connected in parallel to a flow of the refrigerant;

an accumulator configured to separate the refrigerant flowing out of the first evaporator into gas and liquid to store a surplus refrigerant;

a compressor configured to draw and compress a gas refrigerant separated in the accumulator; and a bypass passage through which the refrigerant flowing out of the second evaporator flows to a suction port of the compressor while bypassing the accumulator;

a heat medium circuit circulating a heat medium that conveys heat of a first object to be cooled and heat of a second object to be cooled; and a heat medium circuit switching valve configured to switch the heat medium circuit in which heat is exchanged between the heat medium having heat-absorbed from at least one of the first object to be cooled and the second object to be cooled, and the refrigerant flowing through the first evaporator, wherein the heat medium circuit switching valve is configured to switch between:

a first heat medium circuit that exchanges heat between the heat medium that absorbed heat of the first object to be cooled and the refrigerant flowing through the first evaporator, and, at a same time, exchanges heat between the heat medium that absorbed heat of the second object to be cooled and the refrigerant flowing through the second evaporator; and a second heat medium circuit that exchanges heat between the heat medium that absorbed heat of the first object to be cooled and the refrigerant flowing through the second evaporator, and, at a same time, exchanges heat between the heat medium that absorbed heat of the second object to be cooled and the refrigerant flowing through the first evaporator.

* * * * *